US005887637A

United States Patent [19]

Phyper

[11] Patent Number: 5,887,637

[45] Date of Patent: Mar. 30, 1999

[54] APERTURE COVERING SYSTEM

[76] Inventor: Duncan Phyper, 2008-808 Nelson Street, Vancouver, British Columbia, Canada, V6Z 2H2

[21] Appl. No.: 851,207

[22] Filed: May 5, 1997

[51] Int. Cl.[6] ..... A47H 3/00

[52] U.S. Cl. ..... 160/271; 160/290.1; 160/298; 160/172 R

[58] Field of Search ..... 160/274, 321, 160/323.1, 307, 290.1, 298, 133, 172 R

[56] References Cited

U.S. PATENT DOCUMENTS

| | | | |
|---|---|---|---|
| 881,196 | 3/1908 | McCall | 160/321 X |
| 901,067 | 10/1908 | Casson | 160/321 |
| 1,841,126 | 1/1932 | Indeck . | |
| 1,841,384 | 1/1932 | Schmelz | 160/307 X |
| 1,948,262 | 2/1934 | Gabriel | 160/321 X |
| 2,200,329 | 5/1940 | Derman . | |
| 2,324,536 | 7/1943 | Pratt | 160/274 X |
| 2,993,535 | 7/1961 | Taylor . | |
| 3,061,005 | 10/1962 | Bopp et al. . | |
| 3,134,427 | 5/1964 | Landenberger . | |
| 3,308,872 | 3/1967 | Smith . | |
| 3,854,517 | 12/1974 | Nakamura | 160/321 X |
| 3,860,056 | 1/1975 | Bruneau . | |
| 3,862,655 | 1/1975 | Knapper . | |
| 4,096,902 | 6/1978 | Junod . | |
| 4,234,032 | 11/1980 | Stark . | |
| 4,347,885 | 9/1982 | Von Knorring et al. | 160/307 X |
| 4,475,580 | 10/1984 | Hennequin . | |
| 4,836,264 | 6/1989 | Machin . | |
| 4,846,244 | 7/1989 | Rosenfeld . | |
| 4,850,414 | 7/1989 | Lessard . | |
| 5,009,259 | 4/1991 | Miloslaus | 160/323.1 |
| 5,016,701 | 5/1991 | Vore . | |
| 5,052,459 | 10/1991 | Grossenbacher . | |
| 5,137,073 | 8/1992 | Huang . | |
| 5,167,269 | 12/1992 | Abo . | |
| 5,178,199 | 1/1993 | Jackson . | |
| 5,372,173 | 12/1994 | Horner . | |
| 5,381,846 | 1/1995 | Lichy . | |
| 5,511,601 | 4/1996 | Worthington . | |
| 5,542,464 | 8/1996 | Shiina . | |

FOREIGN PATENT DOCUMENTS

| | | |
|---|---|---|
| 1186613 | 5/1985 | Canada . |
| 1186614 | 5/1985 | Canada . |
| 1198665 | 12/1985 | Canada . |
| 1237976 | 6/1988 | Canada . |
| 2143423 | 3/1994 | Canada . |
| 2418860 | of 0000 | France . |
| 2612237 | of 0000 | France . |

*Primary Examiner*—Blair M. Johnson
*Attorney, Agent, or Firm*—Oyen Wiggs Green & Mutala

[57] ABSTRACT

A covering system for apertures, such as windows, has a cross bar that is slidably mounted between a pair of tracks. Each end of the cross bar is connected to a belt that circulates in its respective track. The belts positively engage respective pulleys which are connected by a shaft. The cross bar is thereby prevented from becoming skewed as it is slid along the tracks. A locking device locks the cross bar at a desired position along the tracks. The free end of a roller blind may be connected to the cross bar. Preferably the roller blind turns with the pulleys and the belts are tapered so that the roller blind rolls and unrolls at the same rate that the cross bar is moved. This makes it unnecessary for the roller blind to be spring loaded. The cross bar may also be used to support horizontal or vertical slatted blinds.

44 Claims, 15 Drawing Sheets

30
43
88A
88B
88A
32
36L
36R
54
50
34
96
52
113
72
40
107
84
38
63
78
77
76
38
91
42
88
48

APERTURE COVERING SYSTEM

TECHNICAL FIELD

This application relates to a system for retractably drawing a covering over an aperture. The invention has particular application in covering windows and may also be used to provide retractable awnings, and removable covers for the openings in shelves, closets or cabinets. Preferred embodiments of the retractable covering system include a cross member which can be locked at a desired position to secure the free end of an aperture covering.

BACKGROUND

Numerous devices have been proposed for covering apertures, such as windows or other architectural openings. Roller blinds are widely used to cover windows. Roller blinds have a flexible blind which is wound around a spring loaded winding roller at the top end of the window opening. The free end of the blind is attached to a weighted bar. A clutch mechanism in the roller locks the roller against rotation so that the weighted bar remains at a desired height. The clutch can be released, usually by pulling on the weighted bar, to allow the position of the free end of the blind to be adjusted.

The prior art teaches a great many designs for roller blinds. Most of these designs are either complicated, difficult to use or require significant maintenance to keep operational.

Other types of window covering assembly include vertical and horizontal blinds which have vertical or horizontal rigid or semi-rigid slats suspended from a cross member at the top of the opening to be covered. Prior art slatted blinds often have the problem that the slats cannot be stored compactly when the blind is retracted and thus obscure portions of the window or other opening which the blind covers even when the blinds are fully open.

SUMMARY OF THE INVENTION

The invention provides a variety of covering assemblies which avoid some of the disadvantages of the prior art. One aspect of the invention provides an apparatus for supporting a covering over an area. Apparatus according to this aspect of the invention comprises first and second tracks on opposed sides of the area; first and second belts having portions extending respectively along the first and second tracks; a shaft mounted for rotation relative to the first and second tracks, the shaft extending between first and second pulleys which respectively engage the first and second belts; a cross-member extending between the first and second tracks, the cross-member having a first end connected to the first belt and a second end connected to the second belt; and a lock for releasably fixing the cross-member in place along the tracks. When the lock is not engaged, the cross-member is slidably displaceable along the first and second tracks. The belts keep the cross member from becoming skewed and binding in the tracks.

Preferably the lock comprises a first locking member which compresses the first belt against a surface when it is in an engaged position and allows the first belt to slide relative to the surface when it is in a disengaged position. Most preferably the first locking member is on the sliding cross member.

Another aspect of the invention addresses the problem of rolling and unrolling a roller blind in a controlled manner such that the unrolled portion of the roller blind remains tight. Accordingly, the invention provides apparatus including a roller blind on a roller. A free end of the roller blind is connected to a cross member. The roller is connected to rotate with a pulley having a tapered groove. The groove engages a belt which is tapered in width. The belt is connected to move with the cross member to turn the pulley. The tapered belt rounds the pulley in an arc having a radius which remains substantially the same as a radius of the roll as the blind is unrolled from the roll.

Yet another aspect of the invention provides apparatus for supporting a covering over an area. The apparatus comprises: first and second belts supported for circulation on opposed first and second sides of the area. Each of the first and second belts have first and second portions extending along a respective one of the first and second sides of the area. The apparatus also comprises a mechanical linkage connecting the first and second belts so that the first portions of the first and second belts move synchronously along the first and second sides of the area respectively and a cross-member extending across the area between the first and second belts. The cross-member has a first end connected to the first portion of the first belt and a second end connected to the first portion of the second belt. The apparatus also includes a lock for releasably fixing the cross-member in a position along the area. The lock comprises a member having an engaged position wherein a portion of the member is biased against the second portion of the first belt to prevent the first belt from circulating and a disengaged position wherein the cross-member is slidably displaceable along the opening. Preferably the lock comprises a locking member pivotally attached to the first belt and biased by gravity toward an engaged position wherein the lock is engaged.

BRIEF DESCRIPTION OF DRAWINGS

In drawings which illustrate specific embodiments of the invention, but which should not be construed as restricting the spirit or scope of the invention in any way.

DETAILED DESCRIPTION

Figure 1:
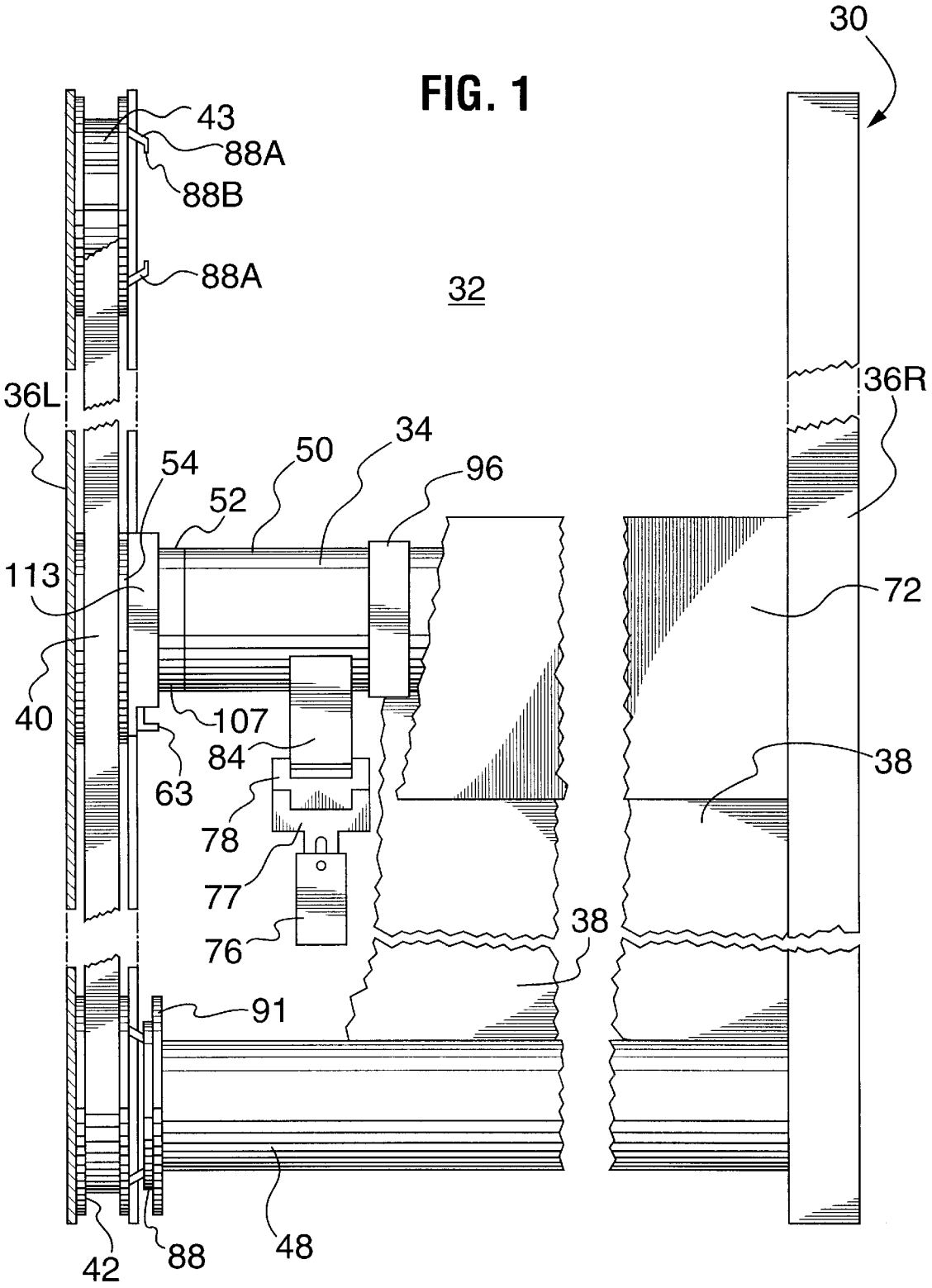
FIG. 1 is a partially cut away schematic view of major components of a window covering assembly according to a preferred embodiment of the invention.

An aperture covering apparatus according to the invention preferably includes a sliding cross bar assembly 30 (FIG. 1). The sliding cross bar assembly is preferably combined either with a roller blind assembly or a horizontal or vertical slatted blind assembly as described below. Sliding cross bar assembly 30 may also be used in combination with prior art aperture coverings, such as spring-loaded roller blinds. These assemblies are described in detail below. To simplify manufacturing, the embodiments of the invention described herein have many parts in common. The various components of the embodiments described herein may be, for example, moulded from suitable plastics in manners which are known to those skilled in the art and will therefore not be described here.

Sliding Cross Bar Assembly

Figure 10:
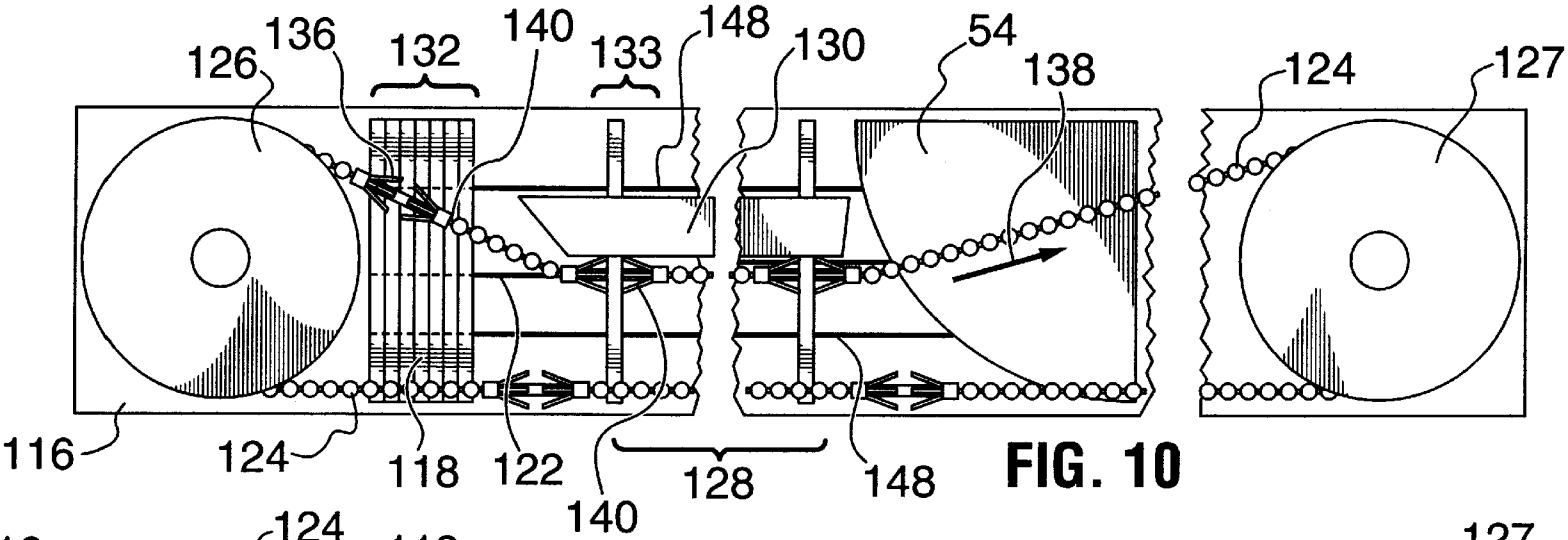
FIG. 10 is a cut away top plan view of the apparatus of FIG. 7.
Figure 11:
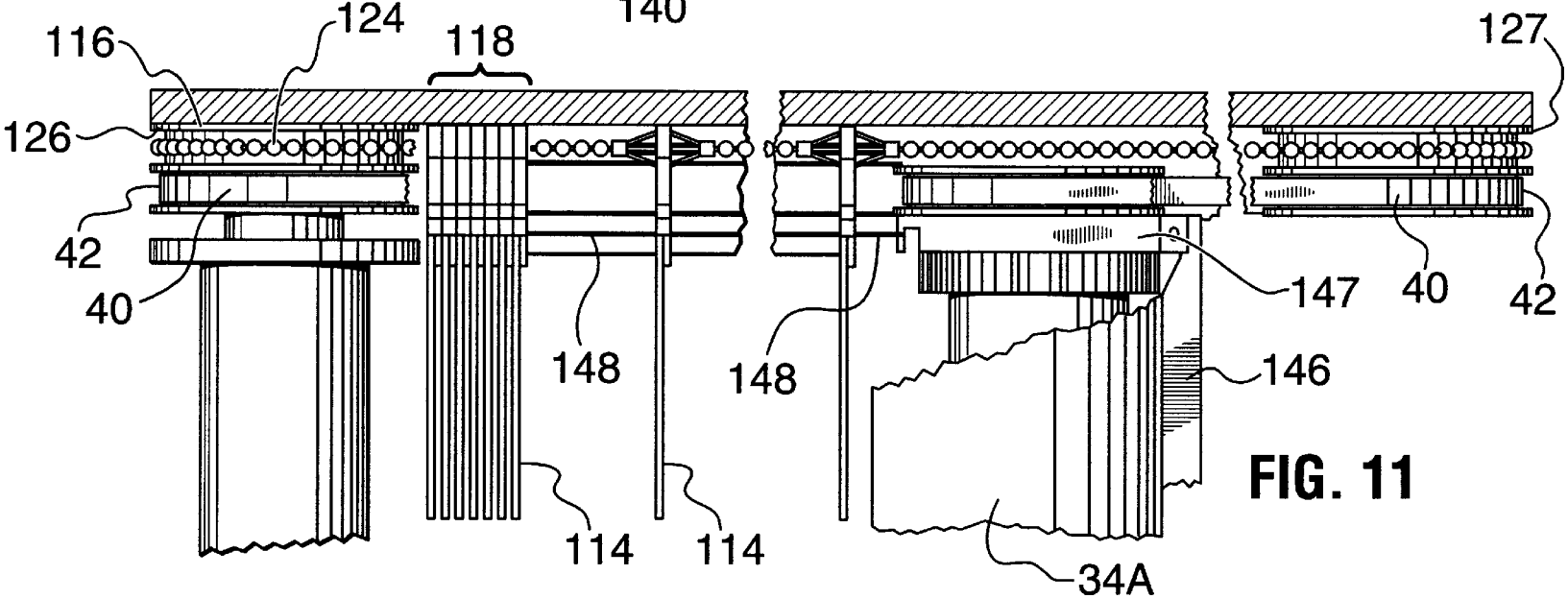
FIG. 11 is a cut away front elevational view thereof.
Figure 12A:
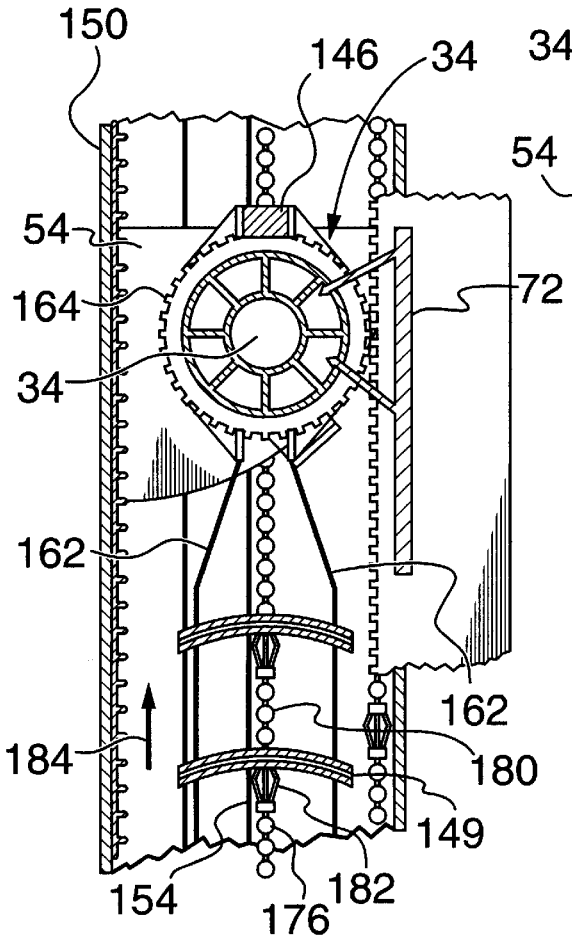
FIG. 12A is a cut away side elevational view of a horizontal slatted blind assembly according to the invention with a locking member in the locked position.
Figure 12B:
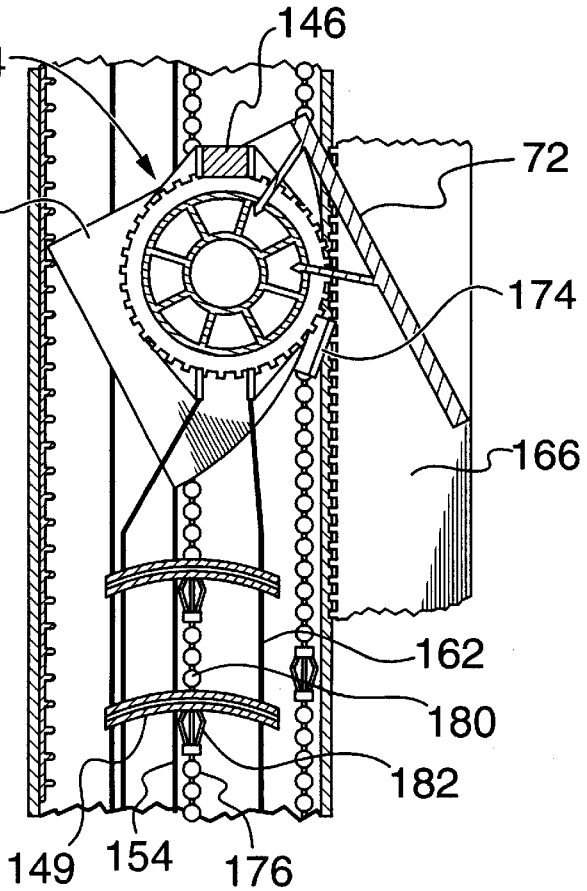
FIG. 12B is a cut away side elevational view thereof with a locking member in its disengaged position.
Figure 13A:
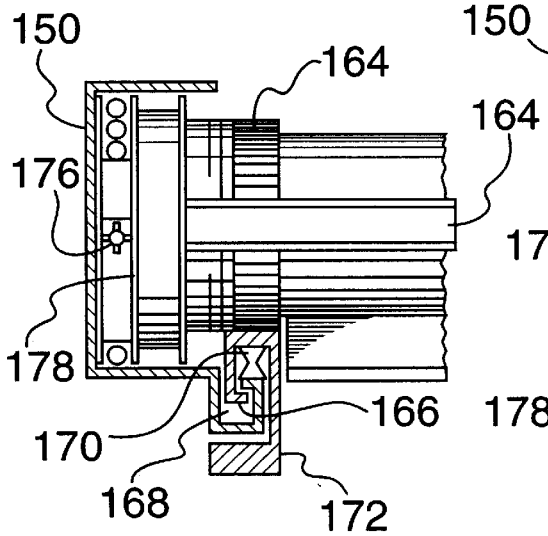
FIGS. 13A and 13B are cut away top plan detailed views of the locking member of the horizontal blind of FIGS. 12A and 12B in its engaged and disengaged positions respectively.
Figure 13B:
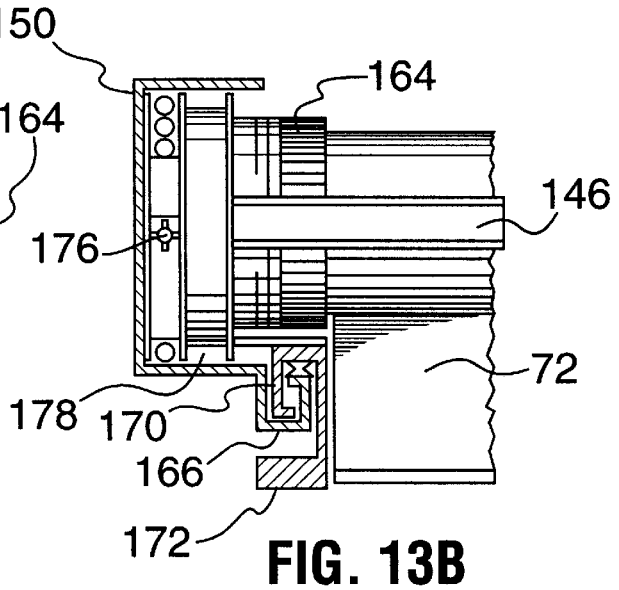
Figure 14A:
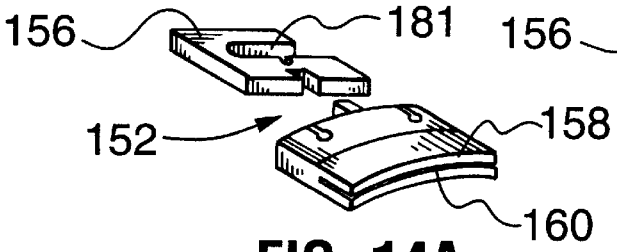
FIGS. 14A and 14B are detailed views of carriers for horizontal slats in a horizontal slatted blind.
Figure 14B:
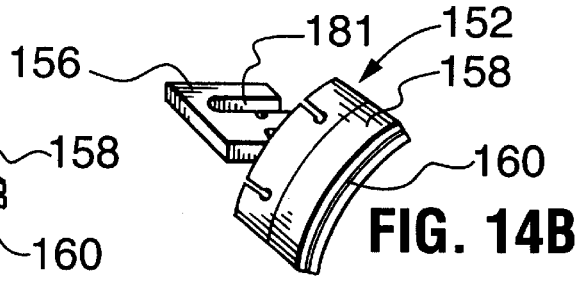
Figure 15A:
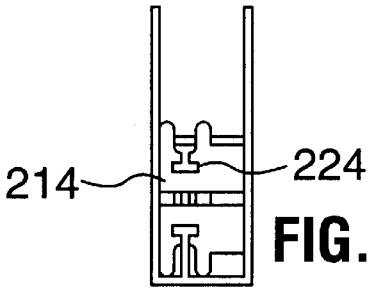
FIGS. 15A and 15B are views of a dealing device for the overhead storage of horizontal slats.
Figure 15B:
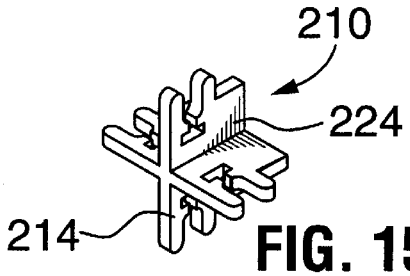

FIG. 1 shows a sliding cross bar assembly 30 according to the invention mounted in a window opening 32. While the following description relates to a window opening 32, those skilled in the art will appreciate that the invention could readily be used to apply coverings to apertures of other kinds such as the entrances to cupboards or closets, openable portions of room dividers, awnings or the like. Sliding cross bar assembly 30 includes a cross member 34 which can be slid to a desired position along tracks 36L, 36R (collectively tracks 36) and then locked in position. Tracks 36L, 36R extend along 2 sides of window opening 32. While cross member 34 is shown extending horizontally between vertical tracks 36L, 36R the orientation of sliding cross bar assembly 30 is not important. In some applications, for example, as shown in FIGS. 10 and 11, tracks 36L, 36R may be horizontal while cross member 34 extends vertically.

Cross member 34 supports one end of a covering 38 for opening 32. Covering 38 is typically a flexible covering, such as a roller shade, a pleated shade, a slatted blind, or the like, as is described in more detail below. Covering 38 may also be a rigid covering, such as a framed window pane (not shown) slidably mounted with respect to opening 32 and supported by cross member 34.

The extent to which covering 38 covers area 32 can be varied by moving cross member assembly 34 and locking it at a desired position along tracks 36L, 36R. Covering 38 may extend to cross member 34 from either the top or the bottom side of window opening 32.

Figure 2A:
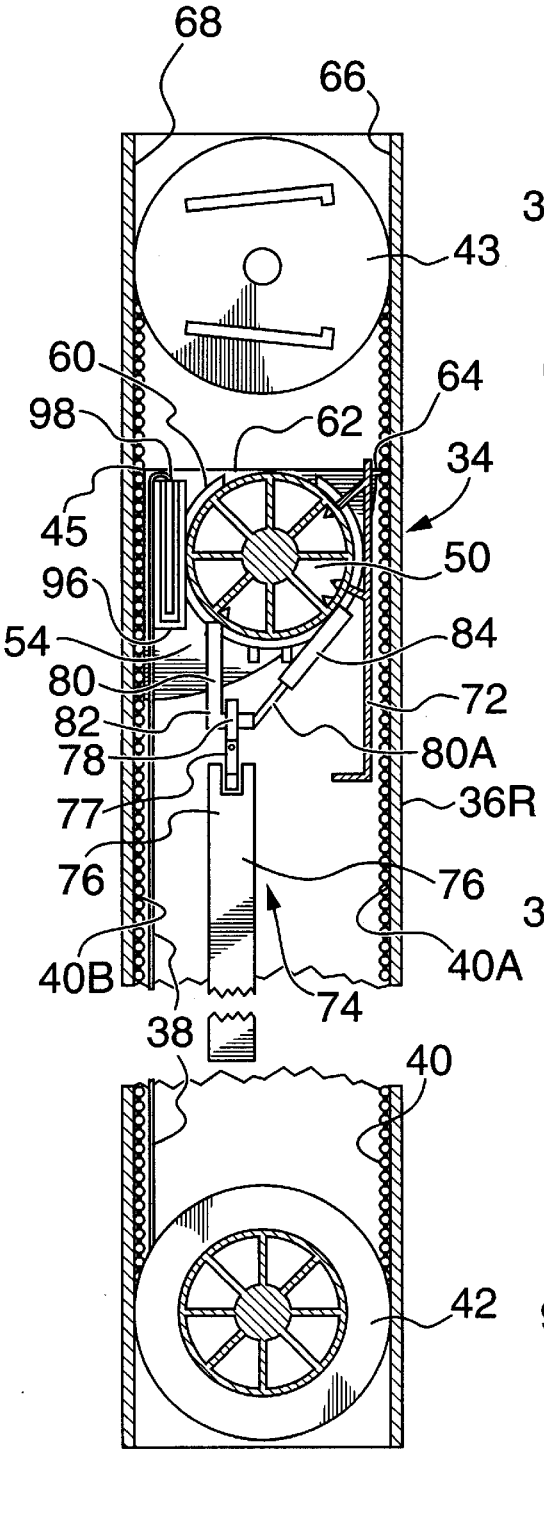
FIGS. 2A and 2B are cut away elevations of the apparatus of FIG. 1 with the cross member in its locked and unlocked positions respectively.

The invention provides a mechanism to prevent cross member assembly 34 from becoming skewed as it is moved along tracks 36L, 36R. This mechanism preferably comprises a pair of belts 40. Belts 40 are each mounted so that they may be circulated in respect of a respective one of tracks 36L, 36R. Preferably, each of tracks 36L, 36R has pulleys 42, 43 pivotally mounted at its ends. Each belt 40 passes around the pulleys 42, 43 on its respective track. Left and right ends of cross member 34 are each connected to one of belts 40 at connecting points 45 (FIG. 2A).

Belts 40 are coupled so that they move in unison. This can be conveniently done by connecting pulleys 42 and/or pulleys 43 together by a linkage so that pulley 42 (or 43) from track 36L turns together with pulley 42 (or 43) from track 36R. Preferably the linkage comprises a shaft 48 fixed to pulleys 42 (or pulleys 43). Shaft 48 causes pulleys 42 to rotate together. Belts 40 positively engage pulleys 42 (and/or 43). Belts 40 are preferably toothed belts such as narrow timing belts and pulleys 42, preferably have teeth which engage the teeth on belts 40. Other constructions which cause belts 40 to positively engage pulleys 42 may be used. For example, pulleys 42 may have pins which stick into and positively engage belts 40 or belts 40 may comprise chains of beads and pulleys 42 may have grooves shaped to positively engage the beads.

With the arrangement described above, cross member 34 is automatically retained at a constant angle relative to tracks 36L, 36R as it is moved along between tracks 36L, 36R. Preferably cross member 34 is maintained perpendicular to both of tracks 36L, 36R. Because belts 40 are linked to move in unison and the ends of cross member 34 are attached to belts 40, both ends of cross member 34 move the same distance along tracks 36L, 36R whenever cross member 34 is moved. Consequently, cross member 34 cannot become skewed and bind in tracks 36L, 36R as it is moved along tracks 36L, 36R.

The spacing between tracks 36L and 36R will depend in general on the width or height of the opening 32. Cross member 34 preferably comprises a rigid rod 50 affixed between end pieces 52. Preferably end pieces 52 fit into or around the end of rod 50 and are removable. This permits rod 50 to be shipped slightly longer than necessary and then trimmed to the exact length necessary so that cross member 34 spans tracks 36L, 36R. End pieces 52 can be detachably coupled to members 54 which ride respectively in tracks 36R, 36L and are connected to belts 40 at points 45.

Figure 4A:
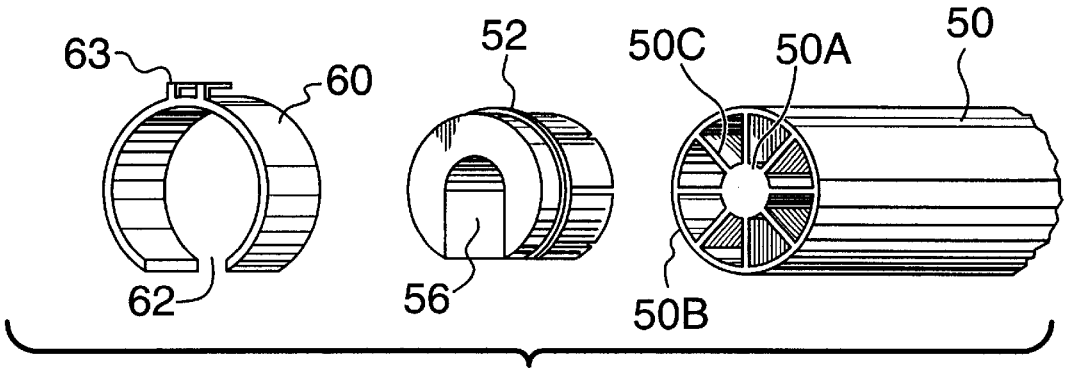
FIGS. 4A and 4B are exploded views of some components from the cross member assembly of a preferred embodiment of the invention.
Figure 4B:
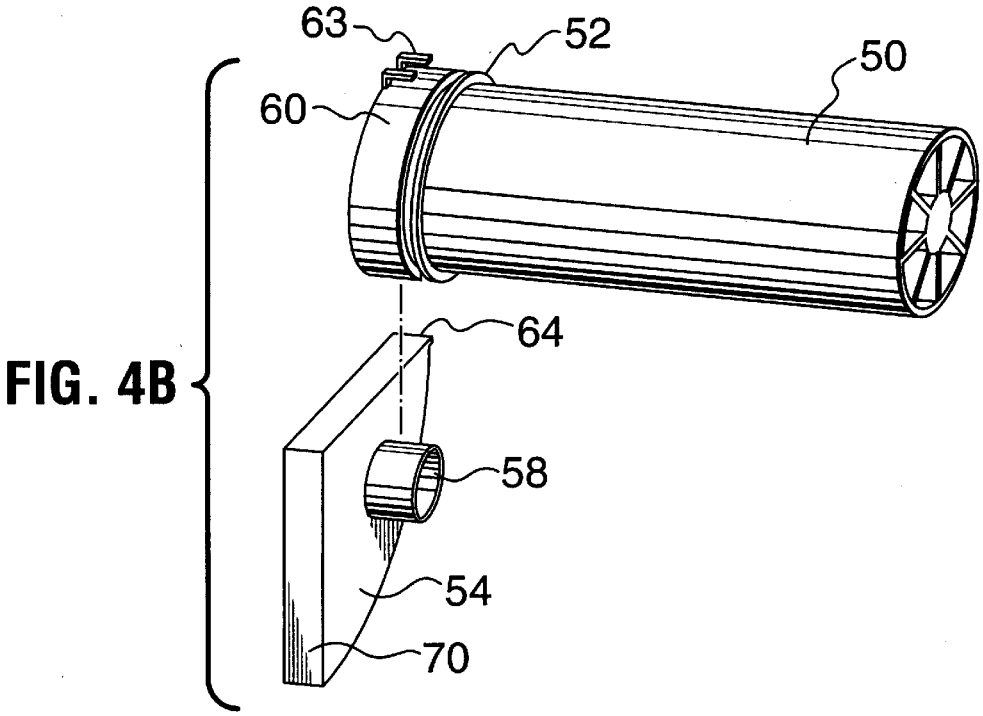
Figure 4C:
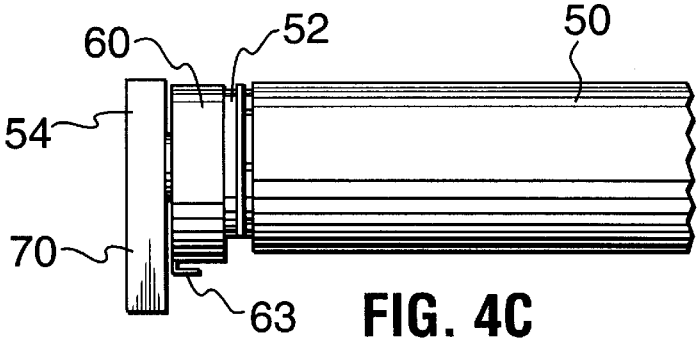
FIG. 4C is a partial assembled view thereof.

Rod 50 may comprise an extruded plastic rod. Most preferably, rod 50 comprises inner and outer cylindrical shells 50A, 50B, connected by radiating webs 50C (FIG. 4A).

Preferably rod 50 is detachable from tracks 36L and 36R. In the currently preferred embodiment of the invention, each end piece 52 has a generally parallel-sided notch 56 in its lower side. End pieces 52 are assembled to rigid rod 50 and aligned between tracks 36L and 36R with notches 56 over oval-shaped projections 58 which extend inwardly from each of members 54. Rod 50 and end pieces 52 can then be dropped into place with projections 58 inside notches 56. Projections 58 and notches 56 are dimensioned so that projections 58 cannot rotate significantly inside notches 56.

A retaining clip 60 fits around each of end pieces 52. Retaining clips 60 have gaps 62 wide enough to slip over projections 58. By rotating retaining clips 60 to align gaps 62 with the mouths of notches 56 it is possible to fit end pieces 52 saddle-like over projections 58 as described above. Retaining clips 60 can then be rotated to close the mouths of notches 56 so that projections 58 are retained in notches 56. Retaining clips 60 may comprise small weights 63 to ensure that gaps 62 tend to be positioned so that the mouths of notches 56 are closed.

Other structures for detachably coupling a rod 50 between tracks 36L, 36R also come within the broad scope of the invention. It will be appreciated that devices according to the invention may also include cross members 34 which cannot be detached from tracks 36L, 36R although this is not preferred.

A locking mechanism is provided to lock cross member 34 in place at a desired position along tracks 36L, 36R. In the preferred embodiment of the invention, the locking mechanism acts on at least one of belts 40, and preferably both of belts 40, to prevent belts 40 from circulating around pulleys 42, 43. Because cross member 34 is attached to belts 40L, 40R at attachment points 45, cross member 34 is held in place when the locking mechanism is engaged.

The invention may be practised with alternative locking mechanisms of many kinds. Preferably the locking mechanism should engage at least one of, and preferably both of, belts 40. Preferably, the locking mechanism includes a locking member which compresses at least one of belts 40 against a surface on the corresponding track 36L, 36R. In preferred embodiments of the invention, members 54 act as locking members. Members 54 are each pivotally attached to the corresponding one of belts 40 at points 45. The pivoting of members 54 may be provided through flexion of belts 40 or, in the alternative, members 54 may be affixed to belts 40 with small hinges.

At least one, and preferably both, of members 54 has a belt contacting portion 64. When a member 54 is pivoted downwardly into its "locked" or "engaged" position, as shown in FIG. 2A, then belt contacting portion 64 compresses a forward portion 40A of belt 40 against an inner surface 66 on track 36. Another internal surface 68 of track 36 bears against the rear side 70 of locking member 54. Therefore, whenever members 54 are pivoted forwardly into their "locked" positions, the forward portion 40A of belt 40 is securely wedged between belt contacting portion 64 and surface 66, thereby preventing belt 40 from circulating about pulleys 42, 43. Rear surface 70 of each member 54 acts as a stop so that members 54 are prevented from pivoting downwardly past their locked positions.

Figure 2B:
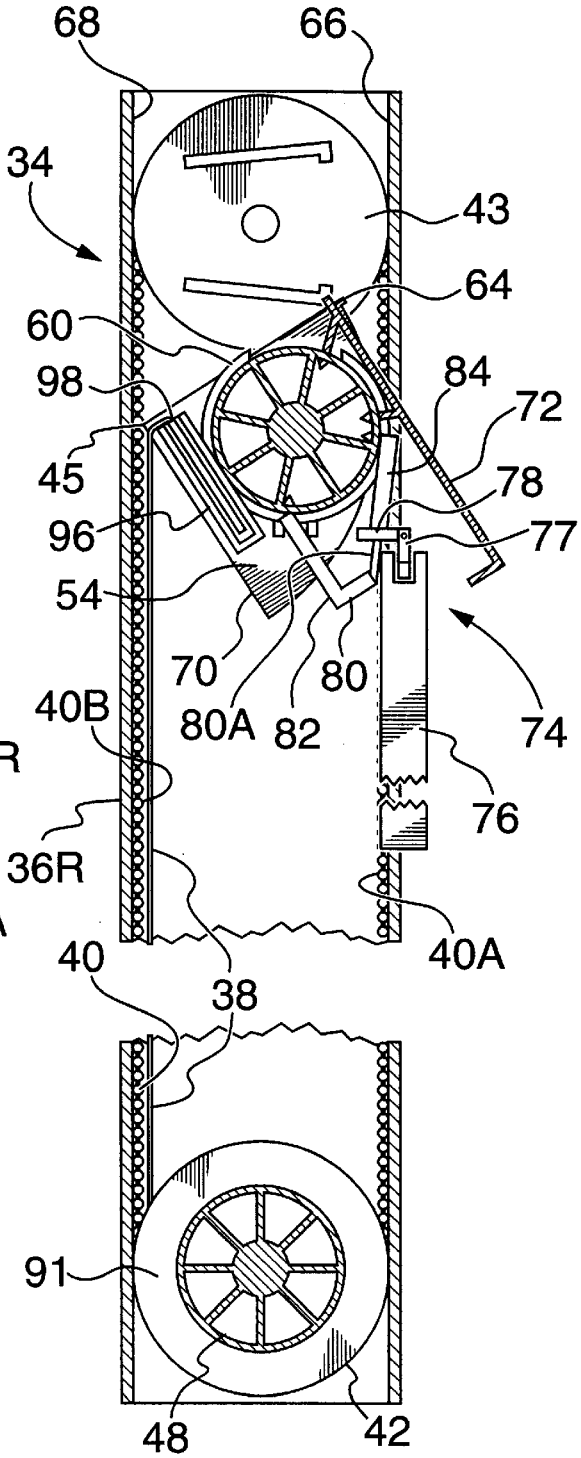

It can be appreciated that members 54 can be pivoted into their "unlocked" positions by pivoting cross member 34 upwardly, as shown in FIG. 2B. Rod 50 acts as a lock-linkage so that members 54 move in unison between their locked and unlocked positions. When cross member 34 is in this unlocked position it can be slid up or down along tracks 36L, 36R as desired. An advantage of the arrangement shown in FIGS. 2A and 2B is that the force of gravity acting on cross member 34 tends to keep members 54 biased toward their locked positions.

The invention, in its broadest sense may be practised with alternative locking means for preventing cross member 34 from moving along tracks 36L and 36R. For example, means may be provided at one or both ends of cross member 34 to frictionally engage portions of track 36L and/or 36R or to positively engage teeth, apertures, indentations or the like in track 36L and/or 36R.

Figure 21A:
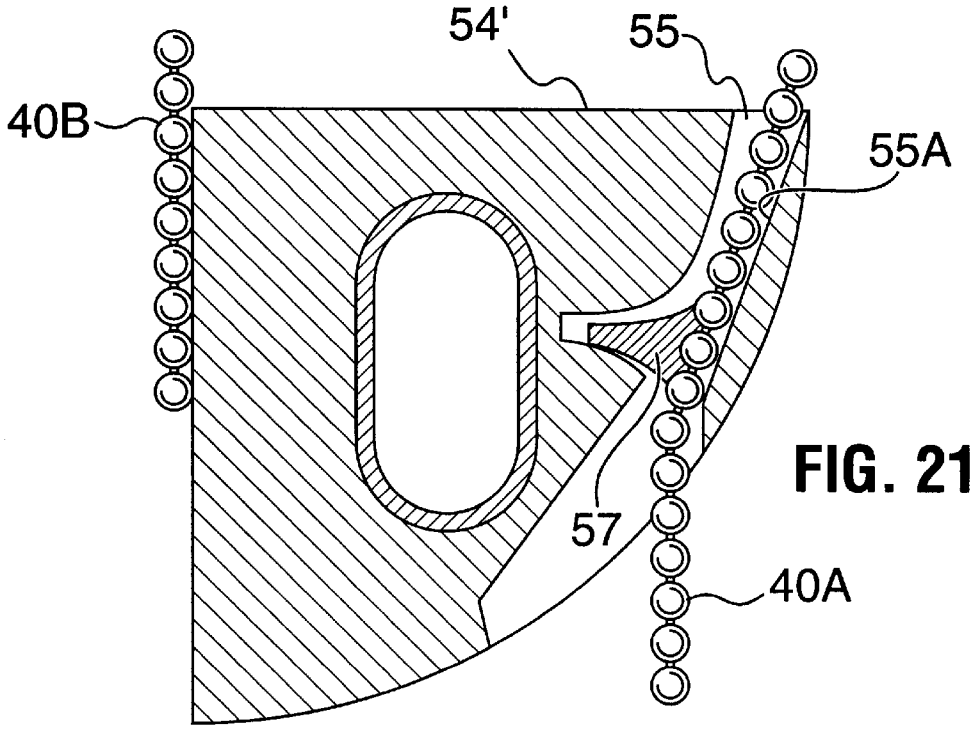
Figure 21B:
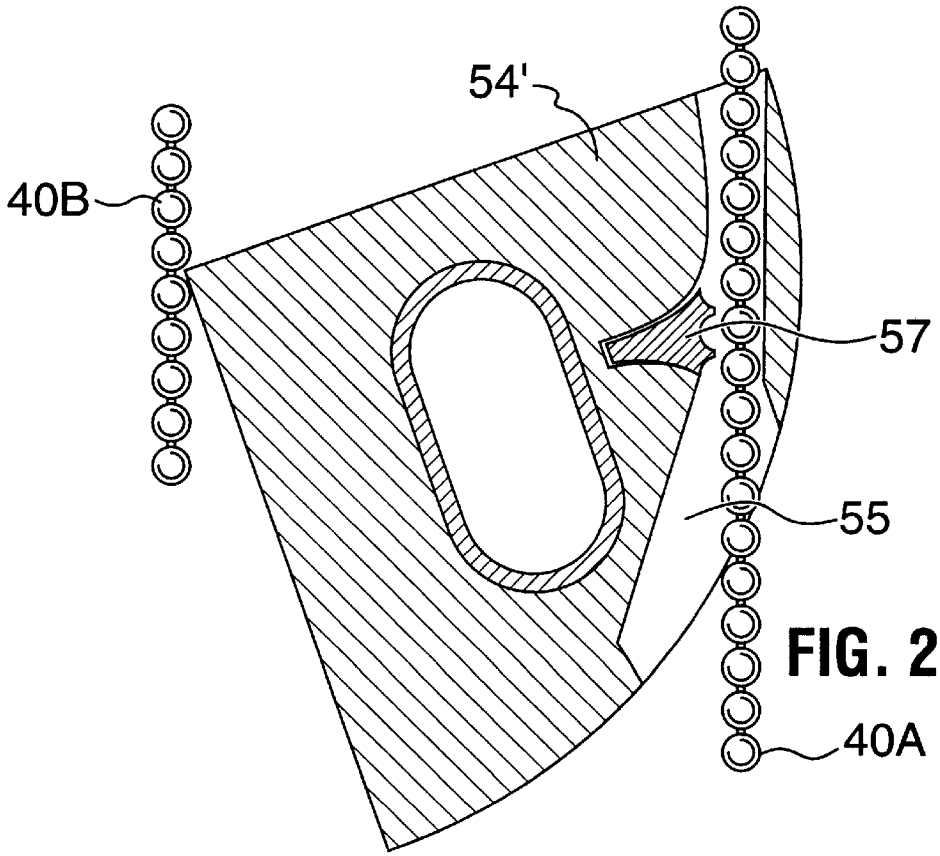

While it is preferred to provide tracks 36, the invention may be practised without tracks 36 by providing a locking mechanism which captures one of belts 40. Without tracks 36, belts 40 may be supported to circulate on either side of opening 32 by mounting pulleys 42 and 43 to suitable structural members adjacent opening 32. As shown in FIG. 21A, a member 54' is connected to a first part (e.g. rear portion 40B) of each belt 40. A second part (e.g. front portion 40A) of each belt 40 passes through a generally vertically extending slot 55 which passes through the corresponding member 54'. In FIGS. 21A and 21B, belts 40 take the form of chains of beads. A locking piece 57 is biased by gravity into contact with the second part of the belt 40 when member 54' is in its "locked" position. Locking piece 57 wedges the second part of belt 40 against the opposite wall 55A of slot 55. When member 54' is tipped upwardly into its "unlocked" position, as shown in FIG. 21B, then locking piece 57 falls away from belt 40 and allows belt 40 to circulate through slot 55.

In the broadest sense, the locking mechanism or "lock" must include some means to keep cross member 34 from moving after it has been set in a desired position. It is highly preferable that the locking mechanism be biased into its "locked" state by gravity acting on a locking member.

Cross member 34 may be provided with a valance 72. Valance 72 serves to hide the various parts of cross member 34 from view and also may be used as a convenient handle to pivot members 54 upwardly into their unlocked positions so that cross member assembly 34 may be moved up or down along tracks 36L, 36R. When cross member 34 is in a desired position then valance 72 may be pivoted downwardly as shown in FIG. 2A thereby placing locking members 54 in their locked positions.

It can be readily appreciated that in some applications the dimensions or location of area 32 will be such that it is not possible for a user to reach valance 72, at least not for all positions of cross member 34. Consequently, a handle assembly indicated generally by 74 may be provided. Handle assembly 74 comprises a push rod 76 which can be pushed upwardly to tilt members 54 into their unlocked positions, thereby permitting cross member assembly 34 to be displaced along tracks 36. If necessary a handle assembly 74 may be provided at each end of cross member 34.

Push rod 76 is preferably connected by a bracket 78 to a U-shaped member 80 which depends from rod 50. Member 80 comprises first and second portions 82 and 84. Bracket 78 is pivotally attached to the end of push rod 76 by a coupling piece 77. Coupling piece 77 is pivotally attached to push rod 76 and bracket 78 at perpendicular pivot axes so that push rod 76 can be pivoted in any direction. A thin portion 80A of member 80 extends through an aperture 86 in bracket 78.

When push rod 76 is pushed upwardly then bracket 78 slides upwardly along thin portion 80A until it contacts the end of member 84. Member 84 is too thick to fit through the aperture in member 78. As push rod 76 is lifted then bracket 78 presses on the end of member 84 and lifts cross member 34 upwardly, thereby moving locking members 54 to their unlocked positions. After locking members 54 have been moved to their unlocked positions then continued upward pressure on push rod 76 causes cross member 34 to slide upwardly.

When push rod 76 is released then bracket 78 slides down to the lower portion of member 80 and the weight of cross member 34 causes locking members 54 to resume their locked positions, thereby holding cross member assembly 34 in place.

If push rod 76 is pulled downwardly and outwardly then the forces on member 82 tend to pivot cross member 34 upwardly about points 45, thereby moving members 54 to their unlocked positions. This process is assisted by the fact that pulling downwardly on rear portions 40B of belts 40 causes forward portions 40A of belts 40 to move upwardly which tends to pivot members 54 toward their unlocked positions. Continued downward and outward pressure on push rod 76 pulls cross member 34 downwardly. When cross member 34 has been drawn to a desired position and push rod 76 is released then the weight of cross member 34 causes members 54 to drop into their locked positions so that cross member 34 is held in its new position.

Figure 3:
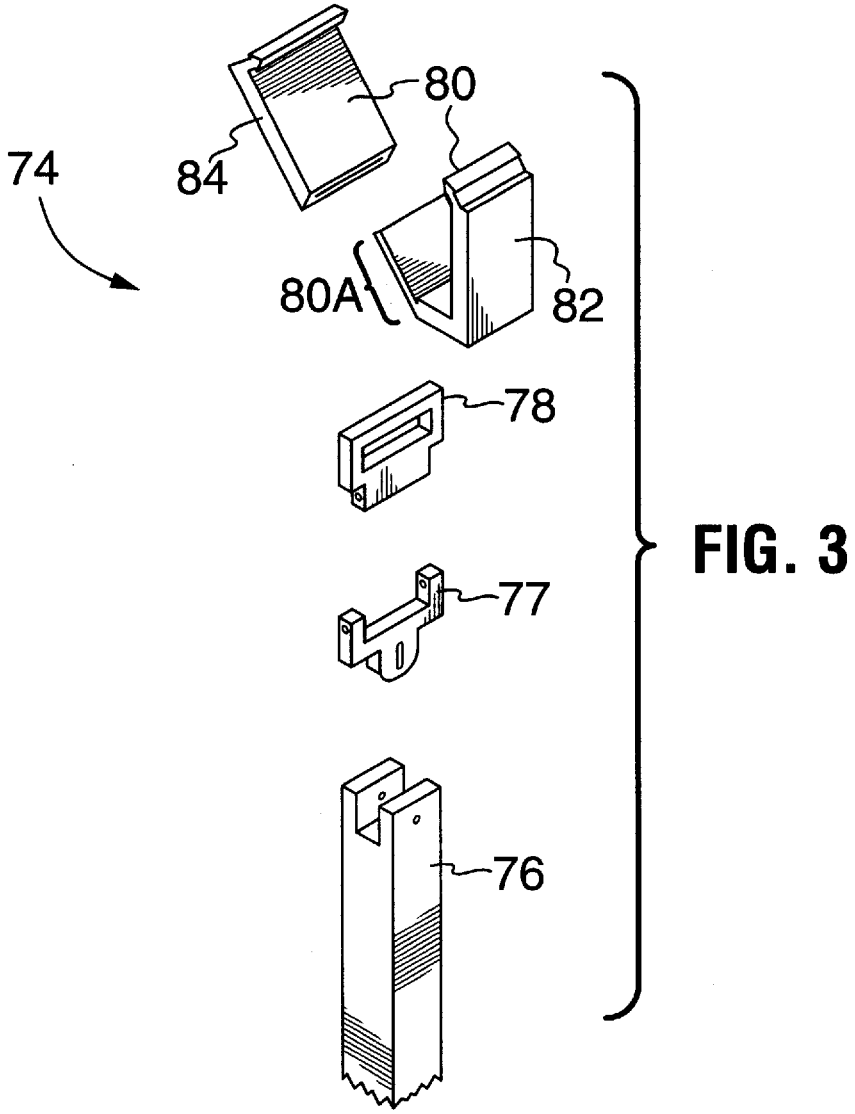
FIG. 3 is an exploded view of components of the locking mechanism in a preferred embodiment of the invention.

As seen in FIGS. 2A, 2B and 3, thin portion 80A of member 82 is preferably slidably received within member 84. This permits member 82 to pivot slightly forwardly as push rod 76 is pulled downwardly and outwardly.

Figure 5A:
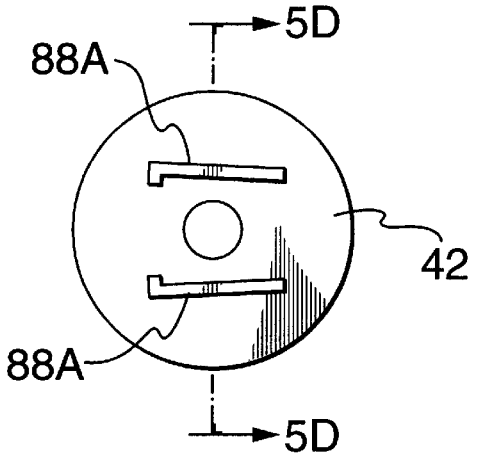
FIG. 5A is a side elevational view of a pulley for use with the invention.
Figure 5B:
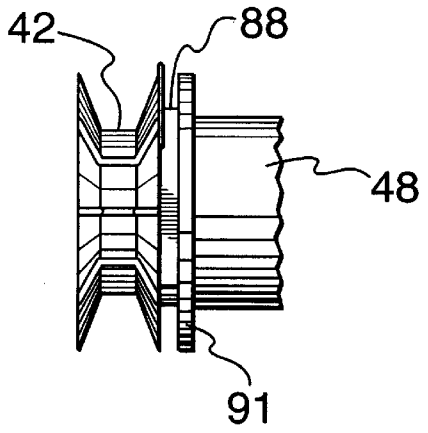
FIG. 5B is a side elevational view of a coupling for attachment to the pulley of FIG. 5A.
Figure 5C:
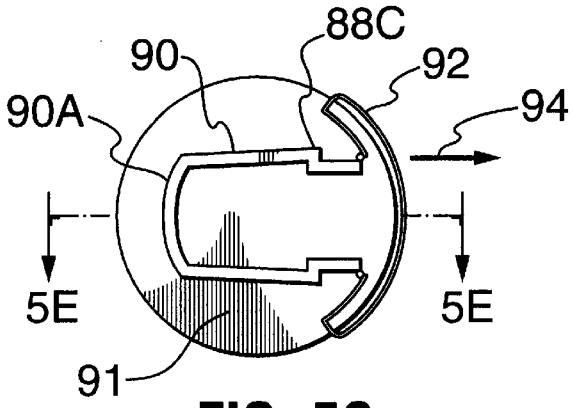
FIG. 5C is a front elevational view of the pulley of FIG. 5A assembled to the coupling of FIG. 5B.
Figure 5D:
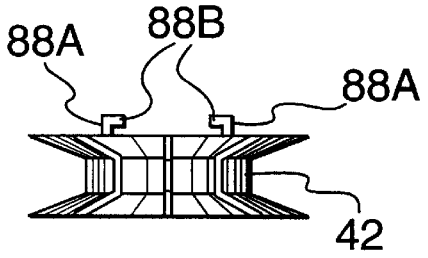
FIG. 5D is a section through the pulley of FIG. 5A along the lines 5D—5D.
Figure 5E:
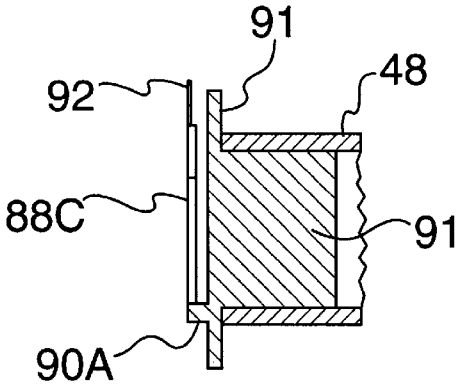
FIG. 5E is a section through the coupling of FIG. 5C along the lines 5E—5E.

Pulleys 42 and 43 are preferably provided with connectors 88 for detachably connecting pulleys 42 to shafts 48. As shown in FIG. 5A, connectors 88 may conveniently comprise a pair of opposed ridges 88A projecting from inward surfaces of pulleys 42, 43. Ridges 88A have inwardly extending flanges 88B and are angled toward each other. A clip 88C on the end of shaft 48 fits under and engages flanges 88B.

Each clip 88C preferably comprises a resiliently flexible generally U-shaped member 90 having free ends connected by a loop 92. Member 90 is attached to the end of shaft 48 at its end 90A. By pulling on loop 92 in the direction of arrow 94 the free ends of member 90 are drawn together so that member 90 may be removed from engagement with flanges 88B. Member 90 is tapered so that it may be engaged with flanges 88B simply by sliding it into place. Preferably clips 88C are mounted to pieces 91 which fit into or around the ends of shaft 48 and are detachable from shaft 48. This permits shafts 48 to be trimmed to a desired length without damaging clips 88C.

Those skilled in the art will understand that a covering assembly, as described, may be used in windows or other openings of various widths and heights. The structure described above has the desirable characteristic that cross member 34 and shaft(s) 48 can be fabricated longer than necessary and readily cut at the time of installation to the lengths necessary to fit between tracks 36L, 36R. Furthermore, the structure described above can be shipped disassembled in a compact bundle which can be assembled at its destination. The structure described above can be installed in an aperture 32 by mounting tracks 36 on either side of the opening 32, cutting rod 50 and shaft(s) 48 to length, installing end pieces 52 and clips 88C on the ends of rod 50 and shaft(s) 48 respectively, and fixing rod 50 and shaft(s) 48 in place between tracks 36 as described above.

Cover 38 may be connected to cross member assembly 34 in any suitable manner. Preferably one or more hooks 96 (FIG. 2A) are attached to rigid rod 50. Hooks 96 detachably hold one end of cover 38. Where cover 38 comprises a sheet-like material (e.g. the fabric of a roller blind) then hooks 96 may conveniently be upwardly facing U-shaped hooks which receive a strip of rigid material 98 is attached at the free end of cover 38. This allows covering 38 to be easily disengaged from rigid rod 50 for cleaning.

It will be appreciated that the sliding cross bar assembly 30 described herein may be used to adjustably position the lower or upper end of a roller blind. The roller blind may be a conventional spring loaded roller blind. In this case the complicated clutch mechanism which is required in prior roller blinds is not needed because the end of the roller blind can be held in place at any desired position along tracks 36 by cross member 34.

Sliding cross bar assembly 30 may also be used to support the upper side of a horizontal Venetian type blind or a rigid member, such as a sliding window. Cross member 34 may also be oriented vertically between horizontal tracks 36. Cross member assembly 30 may then be used to draw vertical slatted blinds or to draw a horizontally rolling roller blind across an opening such as a closet door, the opening in a shelf, etc.

In another variation of the invention, a pair of cross members 34 may be provided in cross member assembly 30 to allow a covering 38 to be drawn from either end of tracks 36L, 36R. In this alternative embodiment of the invention, a separate sets of belts 40 may be used for each cross member 34. In the alternative, both cross members 34 may be attached to the same pair of belts 40 with one cross member 34 attached to front portions 40A of belts 40 and the second cross member 34 attached to rear portions 40B of belts 40. In this alternative configuration, cross members move simultaneously toward or away from the center of aperture 32. In this alternative configuration locking means need only be provided for one of cross members 34 since locking one cross member 34 in place prevents belts 40 from moving. If belts 40 cannot move then the second cross member 34 cannot move as it is attached to belts 40. The locking members 54 on one of cross members 34 may be modified by removing belt contacting portion 64 so that one cross member does not lock.

Roller Blind Tensioning Assembly

Figure 6B:
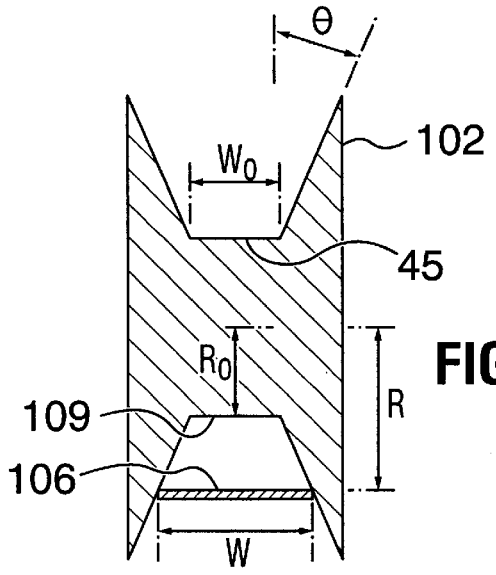
FIG. 6A illustrates a tapered belt assembly for use with a roller blind and FIG. 6B is a detailed view of a tapered belt from the embodiment of FIG. 6A driving a pulley.
Figure 6A:
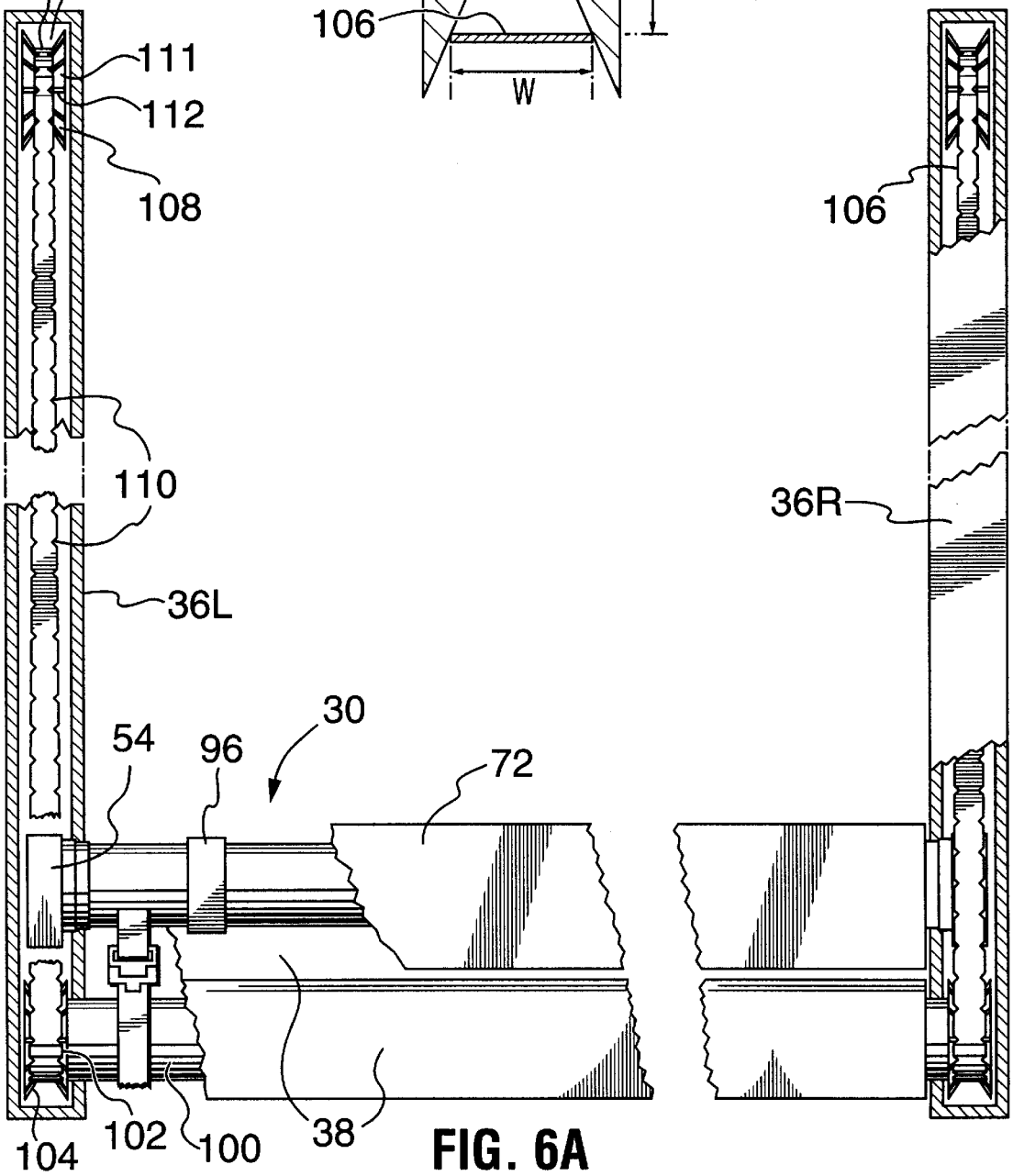
Figure 7:
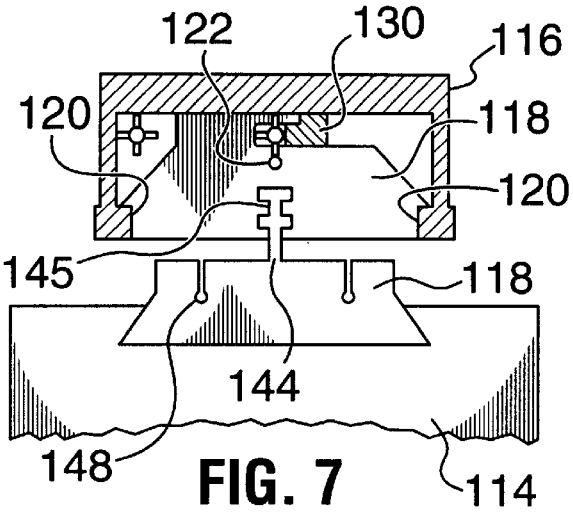
FIG. 7 is the section through a track for a vertical blind according to the invention.

Most preferably, as shown in FIG. 6A, sliding cross bar assembly 30 is combined with a roller blind 38 and a roller blind tensioning assembly of novel construction. A spring assembly is generally required to cause roller blinds to retract. It is difficult to devise a mechanism to accurately wind up or pay out a roller blind because the diameter of the roller onto which the blind rolls varies depending upon the number of times the blind has been wrapped around the roller. When the blind is fully retracted then a large number of layers of blind are wrapped around the roller and the effective diameter of the roller is larger. When the blind is almost fully pulled out the diameter of the roller is smaller because there is relatively little blind material wrapped around the roller. Consequently, if the roller on which the covering is stored is rotated at a constant rate then the covering material will not pay out evenly.

A roller blind tensioning apparatus according to the invention solves this problem by varying the speed of rotation of the roller 100 on which a blind is stored as the blind is unrolled. In the apparatus shown in FIG. 6A, a roller blind 38 is stored on roller 100 which extends between tracks 36L and 36R. Roller 100 is coupled to at least one pulley 102. Pulley 102 has a tapered groove 104 for receiving a tapered belt 106. Tapered belt 106 circulates around pulley 102 and a pulley 108 at the opposite end of its track 36. Preferably pulley 108 is also tapered.

Tapered belt 106 is connected to move with the free end of cover 38. Preferably, the free end of cover 38 is connected to a sliding cross bar assembly 30, as described above. Where this is the case, tapered belt 106 is preferably connected to cross member 34.

Most preferably, two tapered belts 106 are used in place of belts 40 of sliding crossbar assembly 30. In the alternative, one or more tapered belts 106 may be provided to drive the rotation of roller 100 in addition to a separate set of belts 40. In the further alternative, tapered belts 106 may be used in aperture covering assemblies which lack the sliding crossbar assembly 30 described above.

In the embodiment of FIG. 6A, as cross member 34 is moved along tracks 36, tapered belts 106 are circulated around pulleys 102 and 108. When a thin portion of a tapered belt 106 is in pulley 102 then tapered belt 106 rides close to the hub 109 of pulley 102. When a wider portion of a tapered belt 106 is engaging a pulley 102 then belt 40 follows a larger radius curve around pulley 102. The taper in the width of tapered belt 106 and the angle of the walls 111 of grooves 104 are selected so that the radius of the curve taken by tapered belt 106 when rounding pulley 102 is always the same as the radius of the roll of covering 38 on roll 100. Consequently, covering 38 is unrolled from or rolled onto roller 100 at exactly the same rate that cross member 34 is moved along between tracks 36.

Tapered belts 106 preferably comprise tapered strips of a stiff material which are wider at their ends and thinner in their middle portions. The ends of each tapered belt 106 are attached to one of locking members 54 of cross member 34 so that each tapered belt 106 forms a closed loop. The thinnest sections of belts 106 are preferably equal in width to the width $W_0$ of the base of groove 45.

The tension in tapered belts 106 remains constant as cross member 34 is moved because the with of the portion of tapered belts 106 rounding upper pulleys 108 is increasing when the width of the portion of tapered belts 106 rounding lower pulleys 102 is decreasing, and vice versa.

When cross member assembly 34 is moved towards pulleys 42 then the blind material 38 is wound onto the roll at exactly the right rate to keep the exposed blind material taught. No springs are necessary to accomplish this result. It will be appreciated that the correct taper of tapered belts 106 will depend upon the thickness of material 38 and the slopes of the walls 111 in the grooves 104 of pulleys 102.

The relationship between the radius at which tapered belt 106 rounds pulleys 102 and the width of tapered belt 106 is given by:

$$R = R_0 + \frac{W - W_0}{2\tan\theta} \tag{1}$$

Where:

R is the radius of curvature of the portion of tapered belt 106 passing around pulley 102;

$R_0$ is the radius of the hub 109 of pulley 102;

W is the width of the portion of tapered belt 106 passing around pulley 102 (which is assumed here to be essentially the same in all parts of pulley 102 because belt 106 tapers gradually);

$W_0$ is the with of groove 104 at its base; and,

θ is the angle of the walls of groove 104.

Tapered belts 106 should positively engage pulleys 42. Preferably tapered belts 106 are flat belts with notches 110 along their edges. Notches 110 positively engage radially extending ribs 112 on the walls 111 of grooves 104. The spacing between notches 110 varies with the width of tapered belts 106. In portions where the tapered belt 106 is narrow the belt will be riding close to the hubs of pulleys 102 and notches 110 will be closer together. In places where tapered belts 106 are wider, notches 110 are farther apart.

It is important that notches 110 are properly spaced apart. The precise distance between notches 110 in each portion of tapered belts 106 may be determined by dividing the current circumference of the roll 100 by the number of ribs 112 on pulley 102. The current circumference of roll 100 is given by:

$$C = \pi \times D = \pi \times D_0 + 2NT \tag{2}$$

where D is the diameter of roll 100 and the layers of covering material 38 wound onto roll 100;

$D_0$ is the diameter of the core of roll 100 onto which covering 38 wraps (Preferably the hub 109 of pulley 102 is of the same diameter as the core of roll 100);

N is the number of wraps of covering 38 around roll 100; and,

T is the thickness of covering 38. Typical coverings 38 have thicknesses in the range of ¼ mm to ¾ mm.

While tapered belts 106 have been described as flat belts, chains of beads of varying diameters could be used for tapered belts 106. In the further alternative, tapered belts 106 could be tapered in thickness instead of in width. Tapered belts 106 with a tapered thickness can be used with pulleys 102 having straight-sided grooves 104. The thickness of the belts is tapered in such a manner that the surface of the portion of tapered belt 106 rounding pulley 102 is always level with the next-to-outermost layer of covering 38 on roll 100.

Vertical Blind Assemblies

FIGS. 7 through 11 illustrate a first alternative embodiment of the invention applied to vertical blinds 114. Vertical blinds 114 are suspended from an overhead track 116. A cross member 34A extends between track 116 and a lower track 116A. The upper and lower ends of cross member 34A are connected respectively to belts 40 which circulate around pulleys 42 in upper and lower tracks 116 and 116A substantially as described above in the embodiment of FIG. 1.

Each vertical blind 114 is suspended from a hanger 118. Hangars 118 are slidable along track 116. In the exemplary embodiment of FIG. 7, hangers or "carriers" 118 sit atop inwardly projecting flanges 120 in track 116. Hangers 118 are connected at regular intervals along a thin flexible member, such as a string 122. A leading end of string 122 may be connected to sliding cross member 34A. If hangers 118 are made of a suitable plastic then strings 122 may be formed integrally with hangers 118 as hangers 118 are made.

Hangers 118 may be moved along track 116 by a drive comprising a chain 124 which extends in a loop around a pair of pulleys 126, 127. Preferably, pulleys 126, 127 are fabricated integrally with pulleys 42 and the grooves for receiving chain 124 and belt 40 are respectively of depths such that chain 124 circulates at the same rate as belts 40.

In a central portion 128 of track 116, chain 124 is deflected toward the center of track 116 by a ramp 130. Chain 124 is preferably caused to circulate by moving cross member 34A. As described above, pulleys 126 and/or 127 are preferably coupled for rotation with pulleys 42 so that rotation of pulleys 42 by belts 40 causes chain 124 to circulate. In the alternative, chain 124 may be directly attached to cross member 34A.

When blinds 114 are fully retracted, all but one of blinds 114 and hangers 118 are stacked tightly together in a holding area 132. A leading one of blinds 114 remains at a position 133 in central portion 128. The upper portions of hangers 118 have notches 134. When hangers 118 are in central portion 128 then chain 124 passes through notches 134. Chain 124 has attached to it pairs of opposed spring members 136. The pairs of spring members 136 are spaced apart by the same distance that hangers 118 are spaced apart along string 122. Chain 124 passes through notch 134 in the hanger 118 of leading blind 114. A pair of spring members 136 is on either side of hanger 118.

When it is desired to close vertical blinds 114 then pulley 127 or 126 is turned (by, for example, moving cross member 34A), thereby circulating chain 124 around its path in the direction of arrow 138. Chain 124 and string 122 move hanger 118 of leading blind 114 along track 116.

As chain 124 continues to circulate, the next hanger 118 is pulled out of area 132 by string 122. When the next hanger 118 reaches position 133 the notch 134 of the next hanger 118 engages chain 124. Hanger 118 will engage chain 124 near a pair of spring members 136 because spring members 136 are spaced apart on chain 124 by the same distance as hangers 118 are spaced apart along string 122. When a pair of spring members 136 arrives at notch 134 then resilient arms 140 on spring member 136 are compressed until spring member 136 has been pulled through notch 134. Resilient arms 140 then spring outwardly on the other side of notch 134 thereby capturing hanger 118 between 2 adjacent ones of spring members 136. In this manner, carriers 118 are drawn one by one out of holding area 132, engaged on chain 124 between pairs of spring members 136 and pulled along central area 128 by string 122 and chain 124.

When vertical blinds 114 are closed and it is desired to open vertical blinds 114 then chain 124 is circulated in a direction opposite to arrow 138 by, for example, moving cross member 34A toward holding area 132. As this happens, hangers 118 are carried by chain 124 toward position 133. Chain 124 keeps those hangers 118 in central portion 128 evenly spaced as the blinds are opened. As hangers 118 are carried past position 133, chain 124 is pulled laterally around the end of ramp 130 and becomes disengaged from notches 134. Hangers 118 are then pushed into holding area 132 by subsequent hangers 118.

Figure 8A:
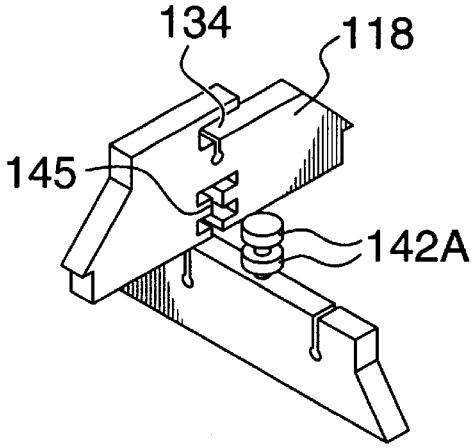
FIG. 8A is a detailed view of a blind hanger from the vertical blind of FIG. 7 and FIGS. 8B and 8C are sectional views thereof.
Figure 8B:
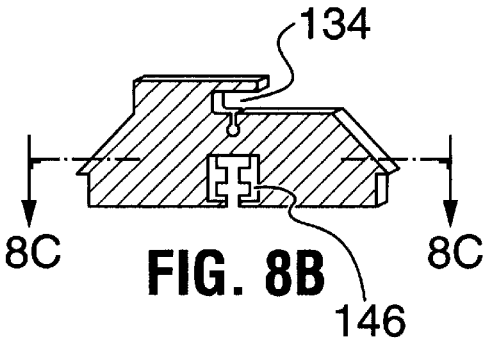
Figure 8C:
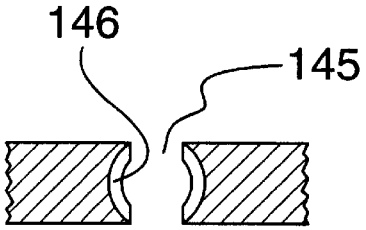
Figure 9:
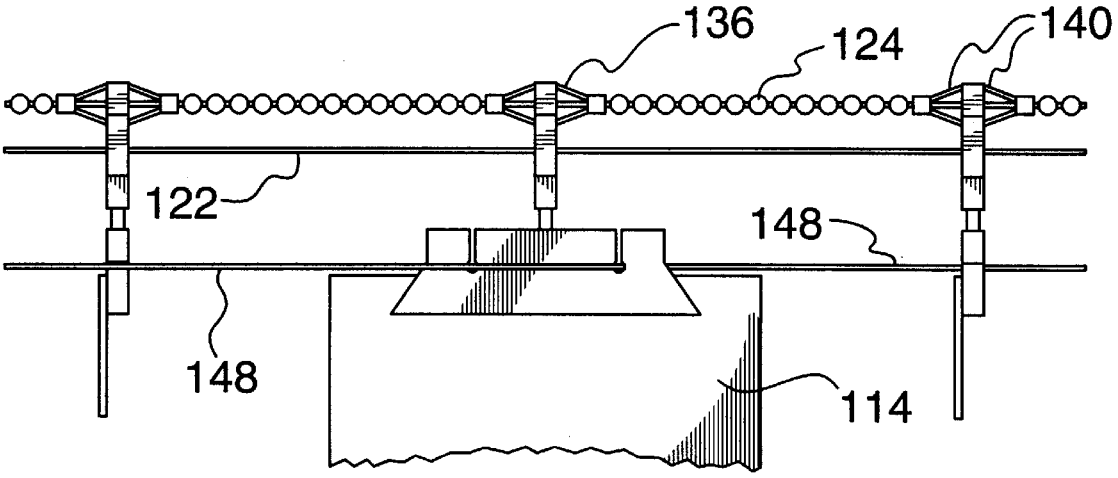
FIG. 9 is a schematic front elevational view illustrating a number of blind slats hanging from a chain.

As shown in FIGS. 8A, 8B and 8C, vertical blinds 114 are preferably pivotally mounted to carriers 118 so that they can be tilted about their vertical axes. Preferably vertical blinds 114 are removably and pivotally affixed to carriers 118. For example, vertical blinds 114 may have a tab 142 projecting vertically from a rigid strip 144 at the upper end of each vertical blind 114. Tabs 142 have projecting arms 142A. Tabs 142 can be slid into slots 145 in hangers 118 by orienting tabs 142 perpendicularly to slots 145 and inserting tabs 142 into slots 145. Each carrier 118 has a central vertically oriented aperture 146 of a diameter longer than the length of arms 142A. When tabs 142 are fully inserted in slots 145 then arms 142A drop down inside apertures 146 into a lower position in which they can be freely rotated about their axes. Blinds 114 can be disconnected from carriers 118 by lifting tabs 142 until arms 142A align with slots 145 and sliding tabs 142 out of carriers 118 through slots 145.

The angle of blinds 114 about their vertical axes can be altered by rotating a pair of collars 147 on cross member 34A. Each collar has connected to it a pair of tilting strings 148. Tilting strings 148 pass through and are connected to each of vertical blinds 114. Rotating collars 147 about cross member 34A pulls tilting strings 148 to cause blind slats 114 to twist. Collars 147 are linked by a rigid connecting rod 146 so that they turn together around cross member 34A.

With the arrangement described above, vertical blinds 114 can be drawn simply by moving cross member 34A to the desired position and then tilting collars 147 to adjust the angles of blinds 114 to provide the desired degree of shading. This is considered to be preferable to the current state of the art in vertical blinds which generally requires the operation of 2 draw strings to close and adjust vertical blinds.

Lower Horizontal Blind Assembly

FIGS. 12A, 12B, 13A, 13B, 14A and 14B show a horizontal slatted blind assembly according to the invention in which horizontal slats 148 are supported below a cross member 34 which extends between a pair of tracks 150 substantially as described above in respect of FIG. 1. Each horizontal slat 148 extends between a pair of carriers 152 (FIG. 14A) which are slidably mounted in tracks 150. Carriers 152 are spaced apart at regular intervals along strings 154. The upper ends of strings 154 are connected to cross member 34. As cross member 34 is slid upwardly from the bottom of tracks 36 then carriers 152 are drawn upwardly on strings 154.

Slats 148 are preferably pivotally mounted to carriers 152. Preferably, each of carriers 152 comprises a carrier member 156 pivotally mounted to a slat retaining member 158. Slat retaining member 158 has a slot 160, which is preferably a curved slot, for receiving the end piece of a slat 148. This construction permits slats 148 to be easily removed for cleaning which is not readily possible with many prior art slatted blinds.

Tilt strings 162 are attached to slat retaining members 158 on either side of the pivotal connections to carrier member 156. The tilt strings allow slat retaining members 158 to be tilted in respect of carrier members 156. Tilt strings 162 preferably extend from rings 164 on cross member 34. Slats 148 can then be tilted by rotating rings 164 to vary the amount of shading provided by slats 148. Rings 164 are connected, preferably by a rod 146 so that rings 164 are constrained to rotate together about cross member 34. Rings 164 may also serve as retaining clips 60.

Rings 164 may not be in a convenient location to reach. Therefore, a mechanism is preferably provided to rotate rings 164 from a remote location. The mechanism preferably includes a rack 166 which engages ring 164. Preferably rack 166 and ring 164 have meshing teeth. Rack 166 rides in a longitudinal groove 168 in one of tracks 150 and is biased against ring 164 by a spring 170. A forwardly extending handle portion 172 of rack 166 is provided so that a user can grip handle portion 172 to slide rack 166 up or down to rotate ring 164. Most preferably two racks 166 are provided with one rack 166 engaging each of rings 164.

Rack 166 must be disengaged from ring 164 while cross member 34 is being moved. This can be readily accomplished by providing a projection 174 on cross member 34. When cross member 34 is pivoted upwardly to its unlocked position so that it can be moved along tracks 150 then projection 174 pushes rack 166 out of engagement with ring 164. When cross member 34 is locked in place at a new position then spring 170 urges rack 166 back into engagement with the teeth on ring 164.

While it is not necessary in the embodiment of FIGS. 12A, 12B, 13A and 13B in which slats 148 are suspended below cross member 34, chains 176 may be provided in tracks 150 to provide added support to carriers 152. Chains 176 circulate around pulleys 178 at either end of tracks 150.

Chains 176 run near the center of tracks 150 in a central portion 180 of tracks 150. In central portion 180, chains 176 pass through slots 181 in carrier members 156.

Chains 176 are connected to move with cross member 34. This may be accomplished by connecting chains 176 to cross member 34 (for example to the outside portion of locking members 54 and/or by causing pulleys 178 to rotate together with pulleys 42). Pulleys 178 may be fabricated together with pulleys 42.

Spring members 182 are spaced apart along chains 176 by distances equal to the spacing of slats 148. Spring members 182 bear on the undersides of carrier members 156. As cross member 34 is lifted, chains 176 circulate in the direction of arrow 184 at the same speed as carrier members 156 are moved upwardly by strings 154.

An advantage of the blind assembly of FIGS. 12A through 13B is that the ends of slats 148 extend into tracks 150. This prevents significant amounts of light from entering around the ends of slats 148 when slats 148 are fully closed.

Upper Horizontal Slatted Blind Assembly

FIGS. 14A through 16C show a horizontal slatted blind assembly in which slats 186 are deployed from above a cross member 34. Slats 186 are spaced apart at regular intervals along strings 188. The lowermost ends of strings 188 are connected to cross member 34. When cross member 34 is fully raised then all but one of slats 186 are stacked together in a holding area 190. The lowermost one 186A of slats 186 is suspended by strings 188 at a position 192.

A chain 194 circulates in each of tracks 196. Chain 194 is deflected inwardly by a ramp member 198 at a point just below the lower edge of holding area 190. In a central region 200 below ramp member 198, chain 194 runs vertically below holding area 190. Spring members 202 are spaced apart along chain 194 with the same spacing as slats 186 on string 188.

Each of slats 186 is pivotally mounted to a carrier 152 at each of its ends. Carriers 152 have notches 181 for receiving chain 194, as described above. As cross member 34 is lowered then chain 194 circulates in the direction of arrow 206. As cross member 34 is lowered from its fully raised position then chain 194 is pulled downwardly through notches 181 until spring members 202 slip through notches 204. When strings 188 become tight then cross member 34 begins to pull the lowermost slat 186A downwardly.

A dealing mechanism 208 releases slats 186 from holding area 190 as they are needed. Dealing mechanism 208 comprises a paddle wheel 210 pivotally mounted at a lower edge of holding area 190. Slats 186 in holding area 190 are disposed at an angle between the walls of holding area 190. The rear edge of the lowermost slat 186B in holding area 190 rests on a ledge 212. The other slats 186 are supported on top of slat 186B. Preferably the front and rear walls of holding area 190 are contoured, as shown, so that slats 186 in holding area 190 are kept at an angle and so that some of the weight of slats 186 is borne by the walls of holding area 190.

As chain 194 circulates in the direction of arrows 206, spring members 202 engage paddle wheel 210. Each time a spring member 202 passes paddle wheel 210 then paddle wheel 210 rotates by one quarter of a turn. In doing so, the top most paddle 214 on paddle wheel 210 pushes the lowermost slat 186B in holding area 190 off of ledge 212. This causes slat 186B to drop into position 192 where chain 194 then becomes engaged in slots 204 as described above. A pawl member 216 prevents paddle wheel 210 from rotating in the opposite direction. In this manner, as cross member 34 is drawn downwardly, a series of equally spaced slats 186 is lowered from holding area 190 into the region above cross member 34.

When cross member 34 is raised then chain 194 moves in a direction opposite to arrows 206. Carriers 152 below ramp member 198 are lifted upwardly by spring members 202 on chain 194. When slats 186 reach position 192 then chain 194 is pulled laterally over ramp member 198 and becomes disengaged from notches 204 in carriers 152. The motion of chain 194 drives paddle wheel 210 in a reverse direction. This is possible because the motion of chain 194 tilts pawl member 216 into a position where paddle wheel 210 can counter rotate.

Figure 16A:
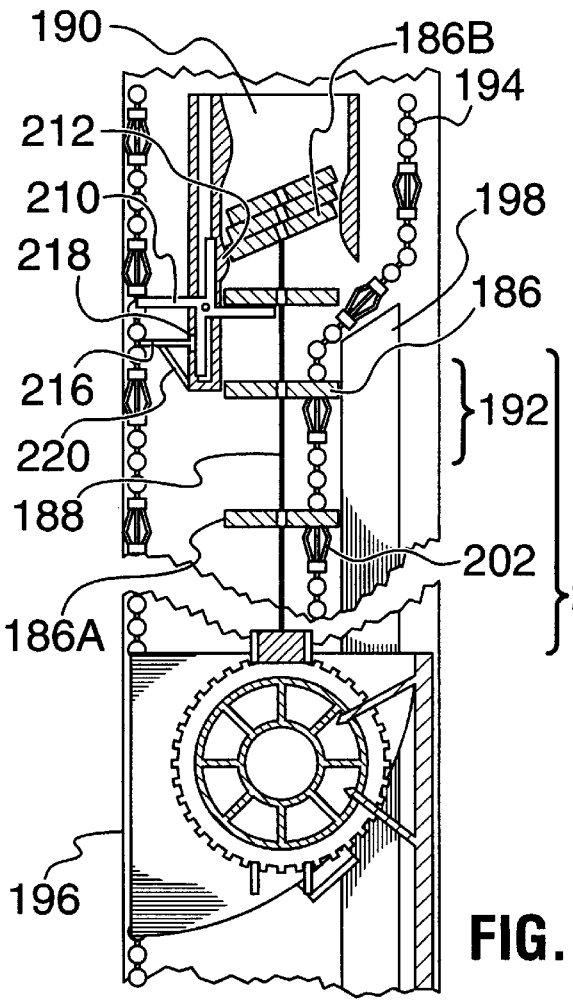
FIG. 16A is a horizontal slatted blind assembly according to an alternative embodiment of the invention.
Figure 16B:
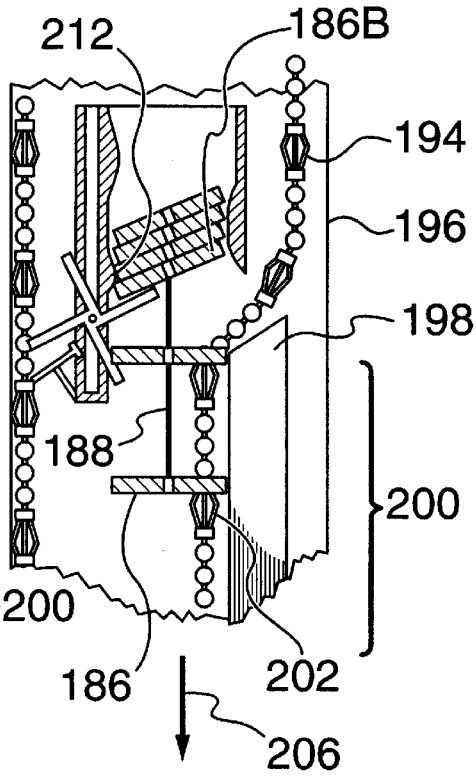
FIGS. 16B and 16C are partial sectional views thereof.
Figure 16C:
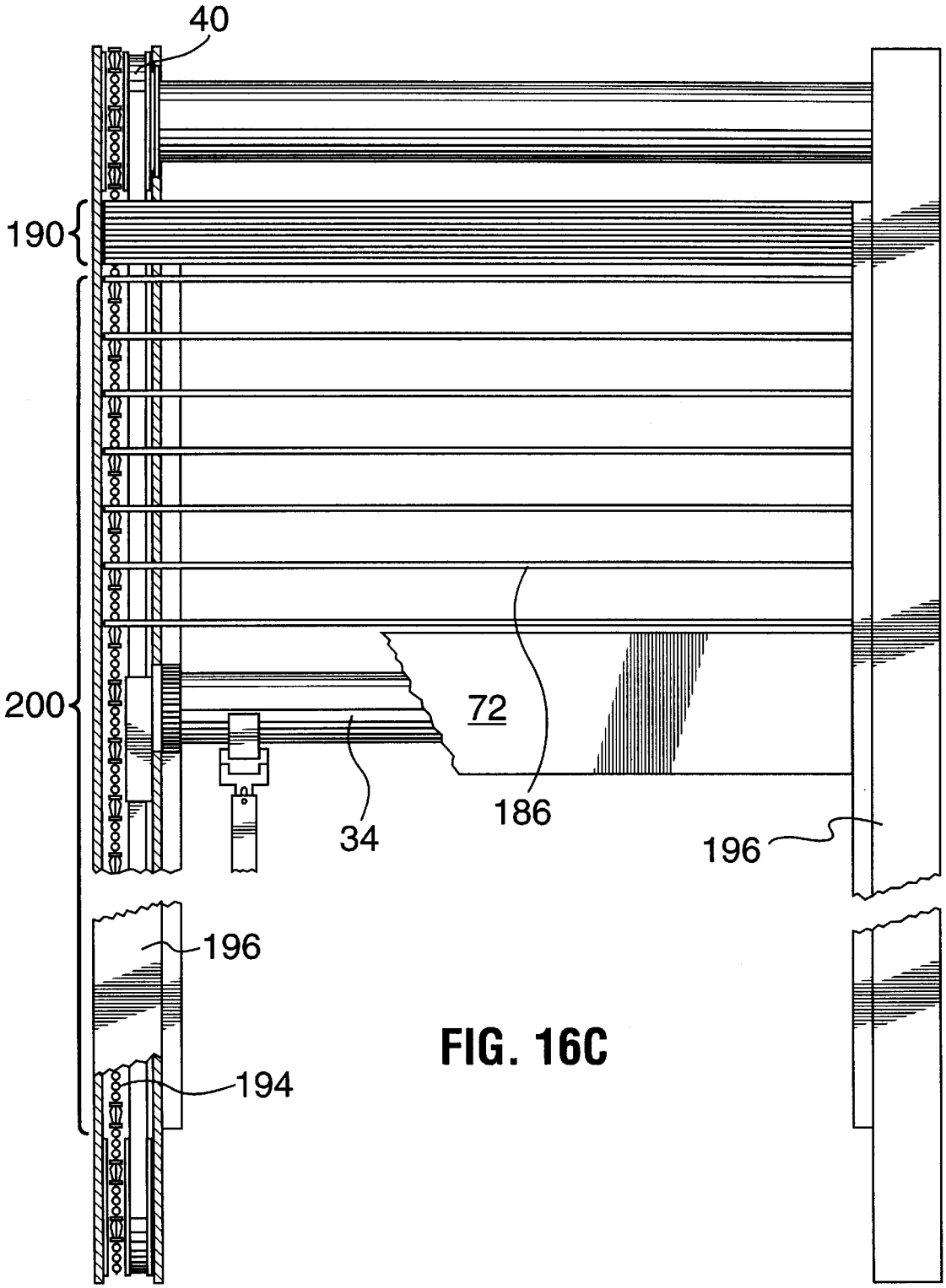
Figure 16D:
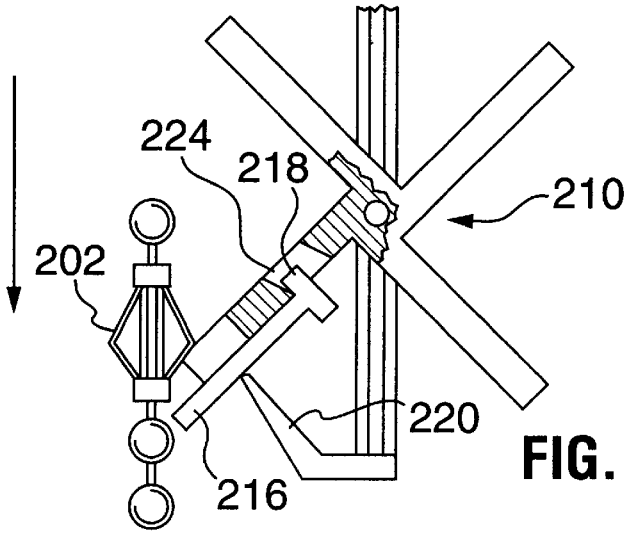
FIGS. 16D, 16E and 16F are a sequence of enlarged views of the dealing mechanism thereof.
Figure 16E:
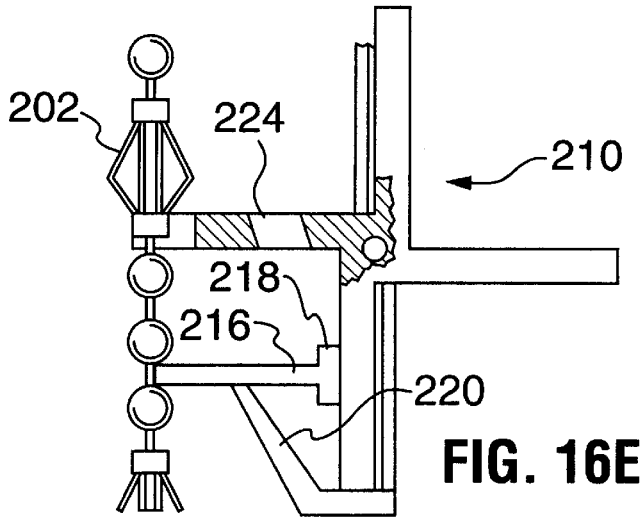

Preferably pawl member 216 has a T-shaped head 218 on a pivotally mounted body 220. The paddles 214 of paddle wheel 210 have T-shaped slots 224. When chain 194 is being moved in a direction opposite to arrows 206 (i.e., cross member 34 is being raised) then spring members 202 on chain pull body 220 so that the head 218 of pawl member 216 is tilted upwardly, as shown in FIG. 16D, into a position wherein head 218 passes through slots 226. This permits chain 194 to turn paddle wheel 210 as cross member 34 is being raised. When upward motion stops then chain 194 ceases to tilt pawl member 216 and pawl member 216 falls into a position in which it prevents paddle wheel 210 from counter rotating, as shown in FIG. 16E.

Figure 16F:
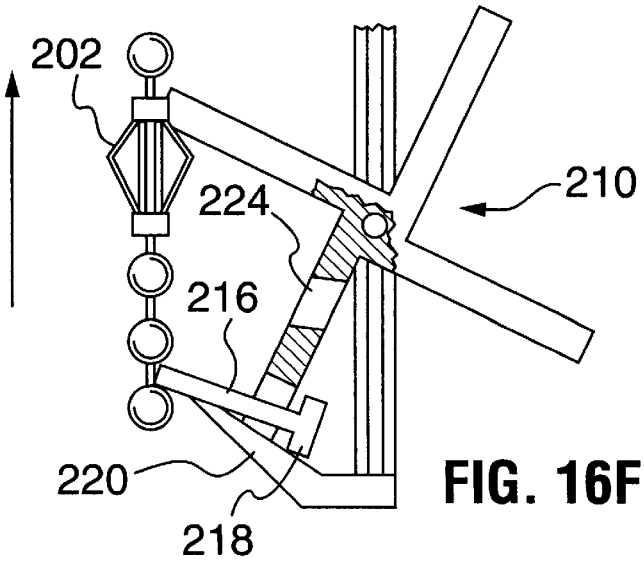
Figure 17:
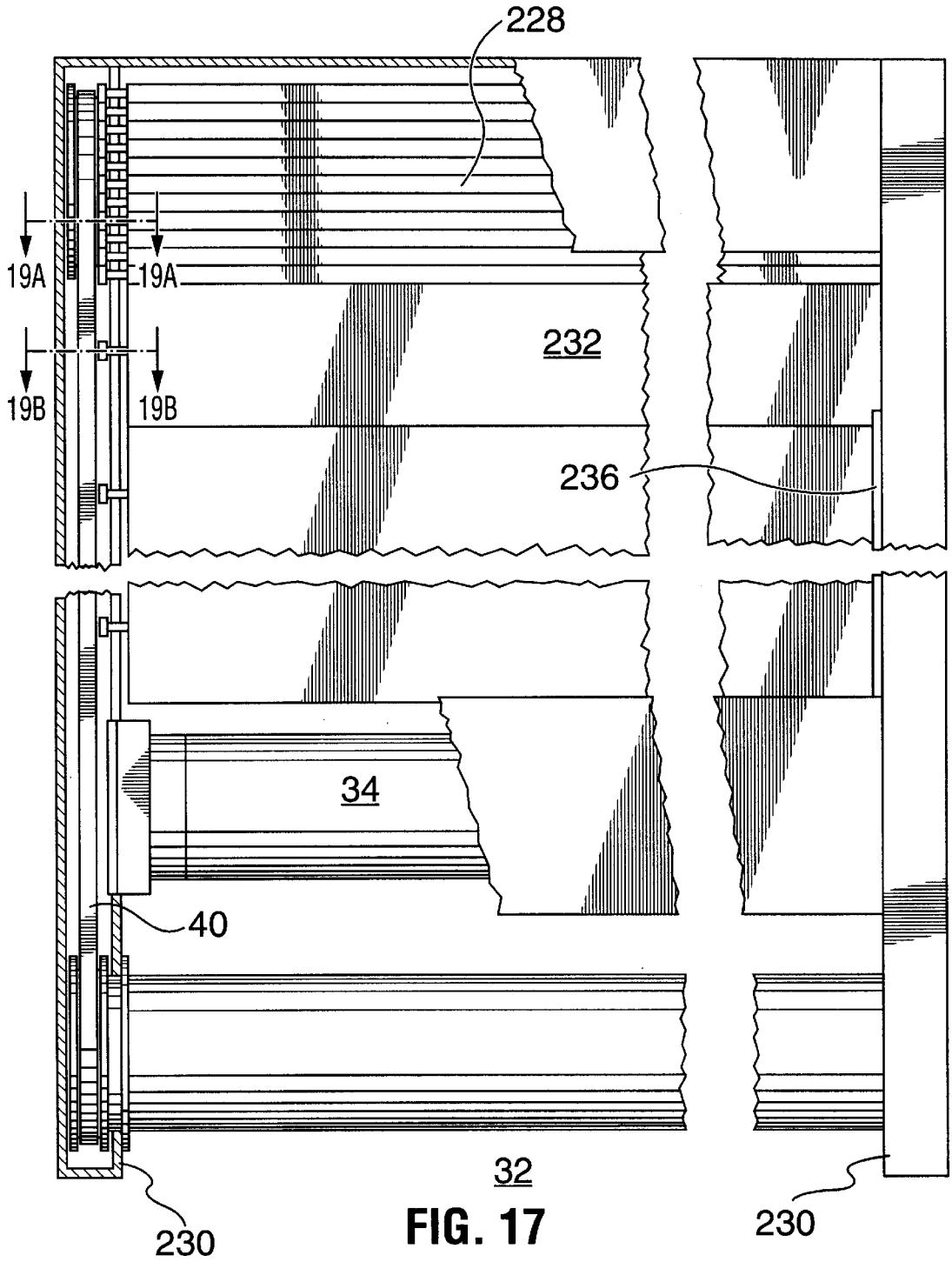
FIG. 17 is a front elevational view of an alternative embodiment of the invention in which the covering comprises interlocking slats.
Figure 18:
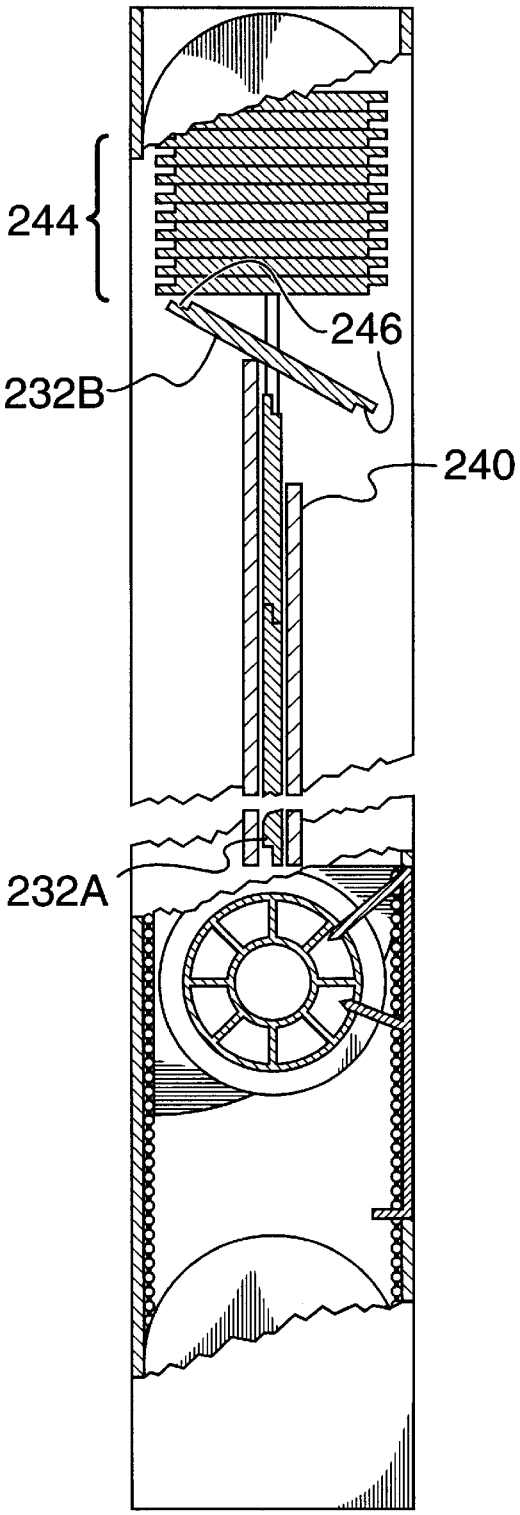
FIG. 18 is a transverse elevational section through the embodiment of FIG. 17.
Figure 19A:
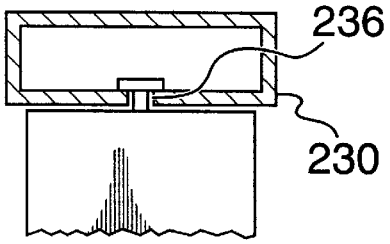
FIGS. 19A, 19B are partial sectional views showing the engagement of the interlocking slats of the embodiment of FIG. 17 with tracks along lines 19A—19A and 19B—19B of FIG. 17.
Figure 19B:
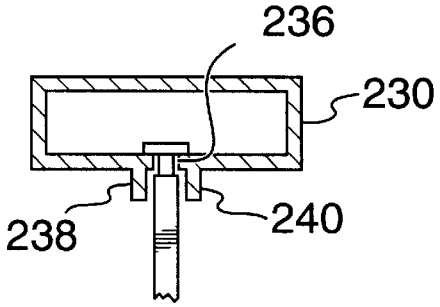
Figure 20:
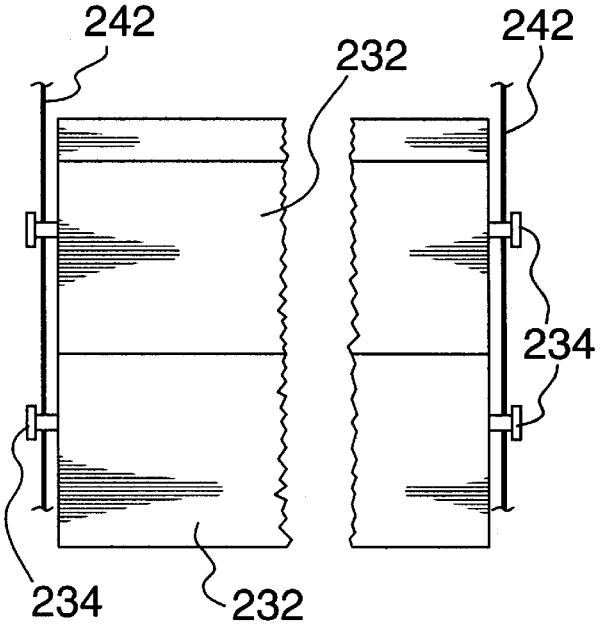
FIG. 20 is a partial longitudinal elevational section through the interlocking slats of the embodiment of FIG. 17 and, FIGS. 21A and 21B are schematic views of an alternative locking member for use in the invention in its engaged and disengaged positions respectively.

When chain 194 is moved in the direction of arrows 206, (i.e. cross member 34 is being lowered), then chain 194 pulls body 220 so that the head 218 of pawl member 216 is tilted downwardly, as shown in FIG. 16F, into a position wherein head 218 passes through notches 226A in the edges of paddles 214. This places pawl member 216 in a position wherein it does not obstruct paddle wheel 210 from rotating as cross member 34 is being lowered.

As cross member 34 is being raised, each time a spring member 202 passes paddle wheel 210 then paddle wheel 210 rotates by one quarter of a turn. As it does so, paddle wheel 210 picks up a carrier 152 from position 192 and lifts the carrier 152 up into holding area 190 until the lower edge of the carrier 152 is resting on ledge 212. Cross member 34 can be raised until all of slats 186 are stored in holding area 190 except for one slat which remains at position 192.

Pivoted Slat Assembly

FIGS. 17 through 20 show an aperture covering system 228 according to a further alternative embodiment of the invention. Covering system 228 comprises a pair of tracks 230, one on either side of aperture 32. A sliding crossbar assembly comprising a cross member 34 extending between a pair of belts 40 as described above with reference to FIG. 1, is mounted to tracks 230.

In aperture covering system 228, covering 38 comprises a number of rigid interlocking slats 232. Pins 234 project from either end of each slat 232 and ride in longitudinal slots 236 in tracks 230 so that slats 232 can slide along tracks 230. Narrow flanges 238 and 240 extend along either side of each of slots 236. Flanges 238 and 240 are spaced apart by a distance only slightly greater than the thickness of slats 232. Flange 238 extends upwardly past the upper end of flange 240 by a distance which is slightly greater than one half of the width of each slat 232.

A leading one 232A of slats 232 is attached to cross member 34. Pins 234 are each connected to one of a pair of flexible members, such as strings 242. Pins 234 are regularly spaced apart along strings 242 by distances approximately equal to the width of slats 232.

When aperture covering system 228 fully "open", all of slats 232 except for leading slat 232A are stacked horizontally in a holding area 244. Aperture covering system 228 is closed by sliding cross member 34 downwardly. As this is done, the lowermost one 232B of slats 232 in holding area 244 is pulled downwardly by strings 242. Because flanges 238 extend farther upwardly than flanges 240, slat 232B pivots over the upper ends of flanges 238 until it is oriented vertically against flanges 238, at which point it can slide downwardly between flanges 238 and 240. The edges of slats 232 preferably have mating rabbets 246 so that the edges of adjacent slats 232 reinforce each other.

Aperture covering system 228 is opened by unlocking cross member 34 and sliding cross member 34 upwardly. Cross member 34 pushes those slats 232 which are in the channel between flanges 238 and 240 upwardly. As each slat 232 reaches the top ends of flanges 238 it is pivoted into a horizontal position over the top edges of flanges 238. Slots 236 may veer toward flanges 238 in their portions just above the top edges of flanges 238 to initiate the pivoting of slats 232 into their horizontal positions in holding area 244. Successive slats 232 are pushed up out of the way into holding area 244. The embodiment of FIGS. 17 through 20 is particularly well suited for use as cupboard doors or doors covering portions of furniture.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. Apparatus for supporting a covering over an area, the apparatus comprising:

(a) first and second belts supported for circulation on opposed first and second sides of an area, each of the first and second belts having first and second portions extending along a respective one of the first and second sides of the area;

(b) a mechanical linkage connecting the first and second belts so that the first portions of the first and second belts move synchronously along the first and second sides of the area respectively;

(c) a first cross-member extending across the area between the first and second belts the cross-member having a first end connected to the first portion of the first belt and a second end connected to the first portion of the second belt;

(d) a lock for releasably fixing the cross-member in a selected position, the lock comprising a member having an engaged position wherein a portion of the member is biased against the second portion of the first belt to prevent the first belt from circulating and a disengaged position wherein the cross-member is slidably displaceable along the area, wherein said lock comprises a locking member pivotally attached to the first belt and biased by gravity toward an engaged position wherein the lock is engaged.

2. Apparatus for supporting a covering over an area, the apparatus comprising:

(a) first and second tracks on opposed sides of an area;

(b) first and second belts each having first portions extending respectively along the first and second tracks;

(c) a mechanical linkage connecting the first and second belts so that the first portions of the first and second belts move synchronously along the first and second tracks respectively;

(d) a first cross-member extending between the first and second tracks, the cross-member having a first end connected to the portion of the first belt and a second end connected to the portion of the second belt;

(e) a lock for releasably fixing the cross-member in place along the tracks;

(f) a covering having one end connected to the first cross member;

wherein, when the lock is not engaged, the cross-member is slidably displaceable along the first and second tracks and wherein, when the lock is engaged, the first cross member is held in a position along the first and second tracks wherein the lock comprises a first locking member on the cross member, the first locking member having an engaged position wherein the first locking member compresses the first belt against a surface and a disengaged position wherein the first belt can move relative to the surface.

3. The apparatus of claim 2 wherein the mechanical linkage comprises a shaft mounted for rotation relative to the first and second tracks, the shaft extending between first and second pulleys which respectively positively engage the first and second belts.

4. The apparatus of claim 2 wherein the surface is a surface on the first track.

5. The apparatus of claim 4 wherein the lock comprises a second locking member on the cross-member, the second locking member having an engaged position wherein the second locking member compresses the second belt against a surface on the second track and a disengaged position wherein the second belt can move relative to the second track wherein the cross-member comprises a lock-linkage for simultaneously moving the first and second locking members between their respective engaged and disengaged positions.

6. The apparatus of claim 5 wherein the first and second locking members each comprise a member having a generally straight edge, a belt attachment point near one end of the edge and a belt contacting portion on a side opposed to the edge, the first locking member pivotally attached to the first portion of the first belt at its belt attachment point and the second locking member pivotally attached to the first portion of the second belt at its belt attachment point, wherein, when the first and second locking members are in their engaged positions, the straight edges of the first and second locking members bear respectively against the first portions of the first and second belts and the belt contacting portions of the first and second locking members bear respectively against second portions of the first and second belts.

7. The apparatus of claim 5 wherein the lock-linkage comprises a transversely extending rigid rod extending between and detachably mounted to the first and second locking members.

8. The apparatus of claim 7 wherein the locking members are wedge shaped.

9. The apparatus of claim 7 wherein the locking members each comprise an inwardly projecting projection and the rigid rod comprises first and second coupling members for detachably engaging the projections.

10. The apparatus of claim 9 wherein the projections are non-circular in section and the first and second coupling members each comprises a slot for non-rotatably receiving one of the projections and fastening means for holding the projection in the slot.

11. The apparatus of claim 10 wherein the fastening means comprises a retaining clip rotatably mounted on an end piece of the rigid rod, the retaining clip having a gap, wherein, when the gap is aligned with a respective one of the slots, the projections can be inserted into the respective one of the slots; and when the gap is not aligned with the respective one of the slots, the retaining clip prevents removal of a projection from the respective one of the slots.

12. The apparatus of claim 11 wherein the retaining clip comprises a weight for biasing the retaining clip toward an orientation wherein the gap is not aligned with the respective one of the slots.

13. The apparatus of claim 12 wherein the rigid rod comprises a hollow tube comprising an inner cylindrical shell, an outer cylindrical shell and a plurality of radial webs extending between the inner and outer shells.

14. The apparatus of claim 6 wherein the first and second locking members are rigidly affixed at either end of the first cross member, the first and second locking members are pivotally connected to the first portions of the first and second belts respectively and the apparatus comprises a push rod connected to the first cross member for pivoting the first cross member about the belt attachment points of the first and second locking members to move the first cross member between a lower engaged position wherein the first and second locking members between are in their engaged positions and an upper disengaged position wherein the first and second locking members are in their disengaged positions.

15. The apparatus of claim 14 wherein the push rod is connected to the first cross member by a connector which slidably engages a U-shaped hook depending downwardly from the first cross member.

16. The apparatus of claim 15 wherein the U-shaped hook comprises a first section connected to the cross member at a point in behind a central axis of the cross member and a second section connected to the cross member at a point in front of the central axis of the cross member, the first section slidably received within the second section, the connector slidably coupled to the first section.

17. Apparatus for supporting a covering over an area, the apparatus comprising:

(a) first and second tracks on opposed sides of an area;

(b) first and second belts each having first portions extending respectively along the first and second tracks;

(c) a mechanical linkage connecting the first and second belts so that the first portions of the first and second belts move synchronously along the first and second tracks respectively, the mechanical linkage comprising a shaft mounted for rotation relative to the first and second tracks and extending between first and second pulleys which respectively positively engage the first and second belts;

(d) a first cross-member extending between the first and second tracks, the cross-member having a first end connected to the portion of the first belt and a second end connected to the portion of the second belt;

(e) a lock for releasably fixing the cross-member in place along the tracks; and, (f) a covering having one end connected to the first cross member, the covering comprising a roller blind comprising a sheet of covering material wound onto a roll connected to turn with the first and second pulleys;

wherein, when the lock is not engaged, the cross-member is slidably displaceable along the first and second tracks and wherein, when the lock is engaged the first cross member is held in a position along the first and second tracks wherein the covering wherein the first and second belts are tapered in width and engage tapered grooves in the first and second pulleys and wherein the first and second belts have widths and the widths of the first and second belts vary such that the first and second belts round the first and second pulleys in arcs having radii which vary such that the radii remain substantially the same as a radius of the sheet of covering material as the blind is unrolled from the roll.

18. The apparatus of claim 17 wherein the belts comprise notched edges and the tapered grooves of the pulleys comprise walls having inwardly projecting radially extending ribs which engage the notched edges of the belts.

19. Apparatus for supporting a covering over an area, the apparatus comprising:

(a) first and second tracks on opposed sides of an area;

(b) first and second belts each having first portions extending respectively along the first and second tracks;

(c) a mechanical linkage connecting the first and second belts so that the first portions of the first and second belts move synchronously along the first and second tracks respectively, said mechanical linkage comprising a shaft mounted for rotation relative to the first and second tracks, the shaft extending between first and second pulleys which respectively positively engage the first and second belts;

(d) a first cross-member extending between the first and second tracks, the cross-member having a first end connected to the portion of the first belt and a second end connected to the portion of the second belt;

(e) a lock for releasably fixing the cross-member in place along the tracks; wherein, when the lock is not engaged, the cross-member is slidably displaceable along the first and second tracks and wherein, when the lock is engaged the first cross member is held in a position along the first and second tracks and, (f) a covering having one end connected to the first cross member; said covering comprising a sheet of material wound around a roller driven by a pulley, the pulley driven in rotation by a tapered belt connected to move with the first cross member wherein the tapered belt rounds pulley in an arc having a radius which varies to remain substantially the same as a radius of the sheet of material as the sheet of material is unrolled from or rolled onto the roll.

20. The apparatus of claim 19 wherein the tapered belt is tapered in thickness.

21. The apparatus of claim 19 wherein the tapered belt is tapered in width and sides of the tapered belt engage sides of a tapered groove in the pulley.

22. The apparatus of claim 21 wherein the tapered belt has notched edges and the tapered grooves of the pulleys comprise walls having inwardly projecting radially extending ribs which engage the notched edges of the belts.

23. The apparatus of claim 22 wherein the belts comprise chains of beads of varying diameters.

24. The apparatus of claim 2 wherein the covering comprises slatted blinds suspended from the cross-member.

25. The apparatus of claim 2 wherein the shaft is detachably affixed to the first and second pulleys by a coupling comprising:

(a) a first ridge;

(b) a second ridge spaced apart from and extending at an angle to the first ridge;

(c) a stop surface on at least one of the first and second ridges;

(d) opposed inwardly projecting flanges on the first and second ridges;

(e) a member having a pair of arms resiliently displaceable toward each other;

(f) an outwardly projecting flange on each of the arms engageable under the flange on one of the ridges;

wherein the coupling can be detached by compressing the arms toward each other and sliding the flanges on the arms out of engagement with the flanges on the ridges.

26. The apparatus of claim 25 further comprising a flexible member extending between the ends of the arms in each coupling whereby the coupling can be detached by pulling on the flexible member to bend the arms toward each other and slide the flanges on the arms out of engagement with the flanges on the ridges.

27. The apparatus of claim 2 wherein the first cross member is connected to rearward sections of said first and second belts and further comprising a second cross-member extending between the first and second tracks, the second cross-member having a first end connected to a forward section of the first belt and a second end connected to a forward section of the second belt, wherein moving the first cross member toward one end of the tracks causes the belts to carry the second cross member toward the other end of the tracks.

28. The apparatus of claim 2 wherein the lock comprises a locking member biased by gravity into a position wherein the locking member compresses one of the first and second belts against a surface on a respective one of the first and second tracks.

29. The apparatus of claim 28 wherein the lock comprises first and second locking members and the cross member comprises a transversely extending rigid rod extending between and detachably mounted to each of the first and second locking members by a connector comprising an inwardly projecting non-circular projection on the respective one of the locking members engageable in a slot on one end of the rigid rod one of the projections and fastening means for holding the projection in the slot.

30. The apparatus of claim 29 wherein the fastening means comprises a retaining clip rotatably mounted on an end piece of the rigid rod, the retaining clip having a gap, wherein, when the gap is aligned with a respective one of the slots, the projections can be inserted into the respective one of the slots, and when the gap is not aligned with the respective one of the slots, the retaining clip prevents insertion and removal of a projection from the respective one of the slots.

31. The apparatus of claim 1 comprising a covering, the covering comprising a plurality of slats extending generally parallel to the cross member, each of the slats comprising a carrier slidably mounted to the first track, the carriers spaced apart at regular intervals along a flexible member, with one end of the flexible member connected to the cross member.

32. The apparatus of claim 31 further comprising a chain circulating around a first path in the first track, wherein the carriers each comprise a coupling for engaging the chain and the couplings engage the chain except when the carriers are in a carrier holding area in the first track.

33. The apparatus of claim 32 wherein each coupling comprises a transversely oriented notch in its respective carrier and the apparatus comprises a ramp directing the chain toward a centerline of the first track at a point adjacent the holding area wherein, as each carrier is drawn out of the holding area the chain engages in the notch.

34. The apparatus of claim 33 wherein the chain comprises a plurality of retainer members regularly spaced apart along the chain at intervals equal to the spacing of the carriers on the flexible member.

35. The apparatus of claim 34 wherein the slats are horizontal, the holding area is above the cross member, the holding area comprises a pair of walls spaced apart by a distance less than a width of the slats, and the holding area comprises a ledge wherein a lowermost slat in the holding area rests at an angle on the ledge and the apparatus comprises dealing means for dealing slats out of the holding area.

36. The apparatus of claim 35 wherein the dealing means comprises a paddle wheel pivotally mounted adjacent the ledge, the paddle wheel comprising paddles which sweep past the ledge when the paddle wheel is rotated.

37. The apparatus of claim 36 wherein the paddle wheel is driven in rotation by motion of the chain.

38. The apparatus of claim 2 wherein the covering comprises a plurality of slats extending between the tracks, each slat comprising first and second ends having respective first and second outwardly projecting pins slidably and pivotally engaged in respective longitudinal first and second slots in the first and second tracks respectively, the first and second tracks comprise front and rear flanges extending along each of the first and second slots, the front and rear flanges on each of the first and second tracks spaced apart by a distance greater than a thickness of the slats wherein, as the cross member is lowered, slats slide between the front and rear flanges behind the cross-member.

39. The apparatus of claim 38 wherein each of the slats comprises a rabbet extending on a first face of the slat along one edge of the slat and a second rabbet extending on a second face of the slat adjacent a second edge of the slat and, when the slats are between the front and rear flanges, the rabbets on adjacent slats overlap.

40. The apparatus of claim 39 wherein, when the cross member is raised, the slats reside in a holding area located between the tracks at an upper end of the grooves above upper edges of the front and rear flanges, with the first faces of the slats in the holding area generally horizontally disposed, and the apparatus comprises pivoting means for pivoting a lowermost one of the slats in the holding area about its pins until the first face of the lowermost one of the slats in the holding area is oriented generally vertically so that the lowermost one of the slats in the holding area can be slidably received between the front and rear flanges.

41. The apparatus of claim 40 wherein upper ends of the front flanges are spaced upwardly past upper ends of the rear flanges and one of the first and second faces of the lowermost one of the slats in the holding area bears on the upper ends of the front flanges, whereby, when the lowermost one of the slats in the holding area is pulled downwardly it pivots over the upper ends of the front flanges until its first and second faces are generally vertical.

42. A roller blind comprising:

(a) a roller rotatably supported in a frame, the roller carrying a sheet of covering material wrapped around the roller;

(b) a member connected to an free end of the sheet of covering material, an unwrapped portion of the sheet of covering material extending from the roller to the member, the member slidable to draw the sheet of covering material over an aperture;

(c) a pulley connected to rotate with the roll; and, (d) a tapered belt connected to move with the member and positively engaging the pulley;

wherein the unwrapped portion of the sheet of material joins a wrapped portion of the sheet of material at a radial distance from an axis of rotation of the roller and the tapered belt forms an arc around the pulley having a radius equal to the radial distance.

43. The apparatus of claim 42 wherein the belt is tapered in width and the pulley comprises a groove defined between a pair of sloping walls.

44. The apparatus of claim 43 wherein the pulley comprises radially extending ribs projecting inwardly from the sloping walls of the pulley groove, the ribs positively engaging notches in side edges of the belt.

* * * * *